US008811858B2

(12) United States Patent
Itabashi et al.

(10) Patent No.: US 8,811,858 B2
(45) Date of Patent: Aug. 19, 2014

(54) CHARGING UNIT AND DISCHARGING UNIT

(75) Inventors: Nao Itabashi, Nagoya (JP); Yasumasa Fujii, Anjyo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 117 days.

(21) Appl. No.: 13/338,884

(22) Filed: Dec. 28, 2011

(65) Prior Publication Data

US 2012/0163867 A1 Jun. 28, 2012

(30) Foreign Application Priority Data

Dec. 28, 2010 (JP) ..... 2010-292872

(51) Int. Cl.
*G03G 15/02* (2006.01)

(52) U.S. Cl.
CPC ..... *G03G 15/0291* (2013.01); *G03G 2215/027* (2013.01)
USPC ..... 399/172; 399/115; 399/171

(58) Field of Classification Search
CPC ..... G03G 15/02; G03G 15/0291
USPC ..... 399/115, 171, 172
See application file for complete search history.

(56) References Cited

U.S. PATENT DOCUMENTS 4,053,770 A * 10/1977 Tanaka et al. ..... 250/324
4,262,075 A * 4/1981 Noda et al. ..... 430/55
5,774,324 A * 6/1998 Hayashi et al. ..... 361/225
2010/0111568 A1* 5/2010 Takaya et al. ..... 399/170
2010/0239315 A1 9/2010 Hazeyama

FOREIGN PATENT DOCUMENTS

JP 61-186972 8/1986
JP 2-063073 3/1990
JP 2-259673 10/1990
JP 4-011551 1/1992
JP 05297684 A * 11/1993 ..... G03G 15/02
JP 8030071 A 2/1996
JP 2006017974 A 1/2006
JP 2010224109 A 10/2010

OTHER PUBLICATIONS

Notice of Reasons for Rejection issued in corresponding Japanese Patent Application No. 2010-292872 mailed Jan. 29, 2013.
Decision of Rejection for Chinese Patent Application No. 201110445866.X mailed May 30, 2014.

* cited by examiner

*Primary Examiner* — Benjamin Schmitt
(74) *Attorney, Agent, or Firm* — Banner & Witcoff, Ltd.

(57) ABSTRACT

A charging and/or discharging unit for an image formation device may include a discharge wire extending in a lateral direction (a second direction) perpendicular to a first direction, the first direction corresponding to a moving direction of the surface of a photosensitive drum and parallel to the surface of the photosensitive drum. The discharge wire may be distanced from the surface of the photosensitive drum. Shield electrodes and a grid electrode are opposed to the discharge wire, with a distance therefrom and extending along the lateral direction. The shield electrodes and the grid electrode may include ribs extending in the lateral direction, respectively. In one or more examples, the ribs may correspond to recessed portions in a surface of the corresponding electrodes and may be located out of a specified circular area.

15 Claims, 22 Drawing Sheets

5

CHARGING UNIT AND DISCHARGING UNIT

TECHNICAL FIELD

Aspects described herein relate to a charging unit and a discharging unit in an image forming apparatus.

BACKGROUND

An example of image forming apparatuses, such as a laser printer, includes a detachable process cartridge in the main body.

Such a process cartridge is generally provided with a photosensitive drum, a charging device, and a developing unit. The photosensitive drum is rotated at a constant rotational speed during image formation. The surface of the photosensitive drum is uniformly charged by the charging device with this rotation. When the uniformly charged portion is selectively exposed to light, a static latent image is formed on the surface of the photosensitive drum. When the static latent image faces the developing unit, toner is supplied from the developing unit to the static latent image to develop the static latent image into a toner image. The toner image is transferred from the photosensitive drum to paper. Thus, image formation onto paper is achieved.

For example, a scorotron charging device has a discharge wire extending in a direction parallel to the rotation axis of a photosensitive drum, a grid electrode interposed between the photosensitive drum and the discharge wire, and shield electrodes formed of metal plates opposed to each other, with the discharge wire therebetween and extending in parallel to the discharge wire. When a high voltage is applied to the discharge wire, corona discharge occurs from the discharge wire. By application of an appropriate voltage to the grid electrode, the amount of electric charge (ions) that reaches the surface of the photosensitive drum is controlled at a constant amount.

In recent years, weight reduction of the process cartridge has been desired.

One method of reducing the weight of the process cartridge is to reduce the thicknesses of the grid electrode and the shield electrodes. However, in some arrangements, the decrease in the thicknesses of the grid electrode and the shield electrodes will decrease the strength of the grid electrode and the shield electrodes along therewith. As a result, the insufficient strength of the grid electrode and the shield electrodes causes problems resulting from deflective deformation in the grid electrode. For example, such problems may include contact between the grid electrode and the photosensitive drum.

BRIEF SUMMARY

Aspects described herein provide a charging unit and a discharging unit that may be reduced in weight while ensuring the strength of a counter electrode facing a discharge electrode.

DETAILED DESCRIPTION

Aspects of the present disclosure will be described in detail hereinbelow with reference to the drawings.

1. Laser Printer

Figure 1:
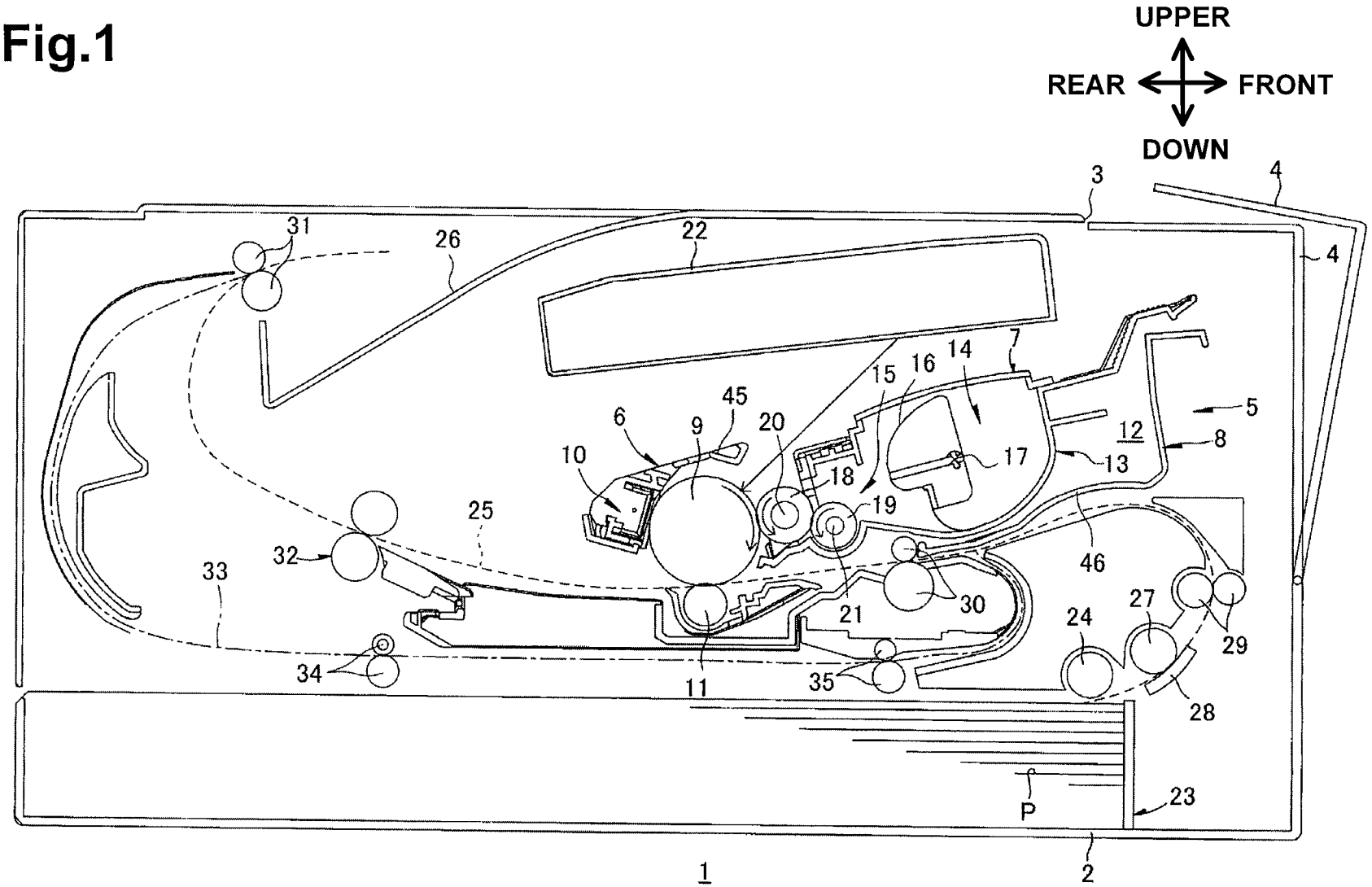
FIG. 1 is a schematic cross-sectional view of an example laser printer equipped with a charging unit according to one or more aspects described herein.

As shown in FIG. 1, a laser printer 1 has a main body casing 2. A side wall at the front of the main body casing 2 has a cartridge ejection port 3 and a front cover 4 that opens and closes the cartridge ejection port 3.

The front side of the laser printer 1 is a front side in the front-to-back direction. With the laser printer 1 placed on a flat surface, a direction perpendicular to the flat surface is a vertical direction. The right and left of the laser printer 1 are defined as viewed from the front of the laser printer 1 placed on the flat surface (e.g., in an operating orientation).

A process cartridge 5 is mounted at a position just in front of a center of the main body casing 2 (e.g., as defined in the front to rear direction). The process cartridge 5 is mounted in the main body casing 2 and dismounted from the main body casing 2 via the cartridge ejection port 3, with the front cover 4 open.

The process cartridge 5 is composed of a drum cartridge 6 and a developer cartridge 7 that is detachably mountable to the drum cartridge 6.

The drum cartridge 6 is equipped with a drum frame 8. At the rear end of the drum frame 8, a photosensitive drum 9, an example of an image bearing member, is rotatably positioned. The drum frame 8 holds a charging device 10 and a transfer roller 11. The charging device 10 and the transfer roller 11 are disposed behind and under the photosensitive drum 9, respectively.

A front portion of the drum frame 8 relative to the photosensitive drum 9 is a cartridge mount portion 12. The developer cartridge 7 is mounted in the cartridge mount portion 12.

The developer cartridge 7 is equipped with a casing 13 for accommodating toner. The casing 13 accommodates a hopper 14 and a developing chamber 15 that communicate with each other so as to be next to each other in a front to back direction.

The hopper 14 is a space for accommodating toner. The hopper 14 is provided with an agitator 16 formed of plastic film. The agitator 16 is configured to be rotatable about an agitator shaft 17 extending in the lateral direction. The toner accommodated in the hopper 14 is sent from the hopper 14 to the developing chamber 15 while being agitated by the rotation of the agitator 16.

The developing chamber 15 is provided with a developing roller 18 and a supply roller 19 that are rotatable about a developing roller shaft 20 and a supply roller shaft 21 extending in the lateral direction, respectively. The developing roller 18 is disposed such that part of the surface (e.g., peripheral surface) thereof is exposed from the rear end of the casing 13. The developer cartridge 7 is mounted to the drum cartridge 6 so that the surface of the developing roller 18 is in contact with the surface (e.g., peripheral surface) of the photosensitive drum 9. The supply roller 19 is disposed so that the surface (e.g., peripheral surface) thereof is in contact with the developing roller 18 from the lower front. The toner in the developing chamber 15 is supplied as a thin layer to the surface of the developing roller 18 by the supply roller 19.

Furthermore, the main body casing 2 accommodates an exposure device 22, having a laser or the like, above the process cartridge 5.

During image formation, the photosensitive drum 9 is rotated clockwise as viewed from the left at a constant speed. With the rotation of the photosensitive drum 9, the surface of the photosensitive drum 9 is uniformly charged by discharge from the charging device 10. On the other hand, a laser beam is emitted from the exposure device 22 on the basis of image data received from a personal computer (not shown) connected to the laser printer 1. The laser beam passes between the charging device 10 and the developer cartridge 7 to radiate the uniformly, positively charged surface of the photosensitive drum 9 to selectively expose the surface of the photosensitive drum 9 to light. Thus, electric charge is selectively removed from the exposed portion of the photosensitive drum 9 to form a static latent image on the surface of the photosensitive drum 9. When the static latent image faces the developing roller 18 by the rotation of the photosensitive drum 9, the toner is supplied from the developing roller 18 to the static latent image. Thus, a toner image is formed on the surface of the photosensitive drum 9.

A paper feed cassette 23 that accommodates paper P is disposed on the bottom of the main body casing 2. A pickup roller 24 for feeding the paper from the paper feed cassette 23 is provided above the paper feed cassette 23.

Furthermore, the main body casing 2 has therein a conveying path 25 formed in S-shape in side view (e.g., left or right). This conveying path 25 extends from the paper feed cassette 23 and between the photosensitive drum 9 and the transfer roller 11 to reach a paper output tray 26 formed on the upper surface of the main body casing 2. A separation roller 27 and a separation pad 28 opposed to each other, a pair of paper feed rollers 29, a pair of resist rollers 30, and a pair of paper eject rollers 31 are provided along the conveying path 25 in the above noted order in a paper-P conveying direction.

Paper is fed from the paper feed cassette 23 and passes between the separation roller 27 and the separation pad 28, which separate the paper to select a single sheet such as paper P (e.g., if multiple sheets are picked up from the cassette 23). Paper P is thereafter conveyed by the paper feed rollers 29 toward the resist rollers 30. The paper P is subjected to resistance by the resist rollers 30 and is then conveyed toward between the photosensitive drum 9 and the transfer roller 11.

When the toner image on the peripheral surface of the photosensitive drum 9 is opposed to the paper P that passes between the photosensitive drum 9 and the transfer roller 11 due to the rotation of the photosensitive drum 9, the toner image is electrically attracted by the transfer roller 11 and is transferred onto the paper P.

A fixing unit 32 is provided at the downstream side of the conveying path 25 in the paper P conveying direction relative to the transfer roller 11. The paper P to which the toner image is transferred is conveyed on the conveying path 25 and passes through the fixing unit 32. At the fixing unit 32, the toner image is fixed as an image onto the paper P by application of heat and pressure.

This laser printer 1 has, as operation modes, a one-side mode in which an image (toner image) is formed on one side of the paper P and a double-side mode in which after an image is formed on one side of the paper P, an image is formed on the other side of the paper P opposite the one side.

In the one-side mode, the paper P, on which an image is formed on one side thereof, is ejected onto the paper output tray 26 by the paper eject rollers 31.

As a configuration for achieving the double-side mode, a reversal conveying path 33 is formed in the main body casing 2. The reversal conveying path 33 extends from the vicinity of the paper eject rollers 31 and between the conveying path 25 and the paper feed cassette 23 and is connected to a portion between the paper feed rollers 29 and the resist rollers 30 on the conveying path 25. On the reversal conveying path 33, a pair of first reversal conveying rollers 34 and a pair of second reversal conveying rollers 35 are provided.

In the double-side mode, after an image is formed on one side of the paper P, the paper P is not ejected onto the paper output tray 26 by the paper eject rollers 31 but is sent to the reversal conveying path 33. The paper P is conveyed on the reversal conveying path 33 by the first reversal conveying rollers 34 and the second reversal conveying rollers 35, where the front and back are reversed, and is sent to the conveying path 25 in an orientation in which the other side on which no image is formed is opposed to the peripheral surface of the photosensitive drum 9. Since an image is formed on the other side of the paper P, image formation on both sides of the paper P is achieved. The paper P, on both sides of which images are formed, is ejected onto the paper output tray 26 by the paper eject rollers 31.

2. Drum Frame

Figure 2:
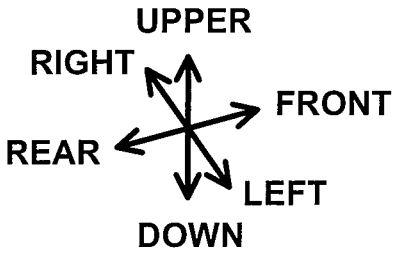
FIG. 2 is a perspective view of an example process cartridge shown in FIG. 1.
Figure 2:
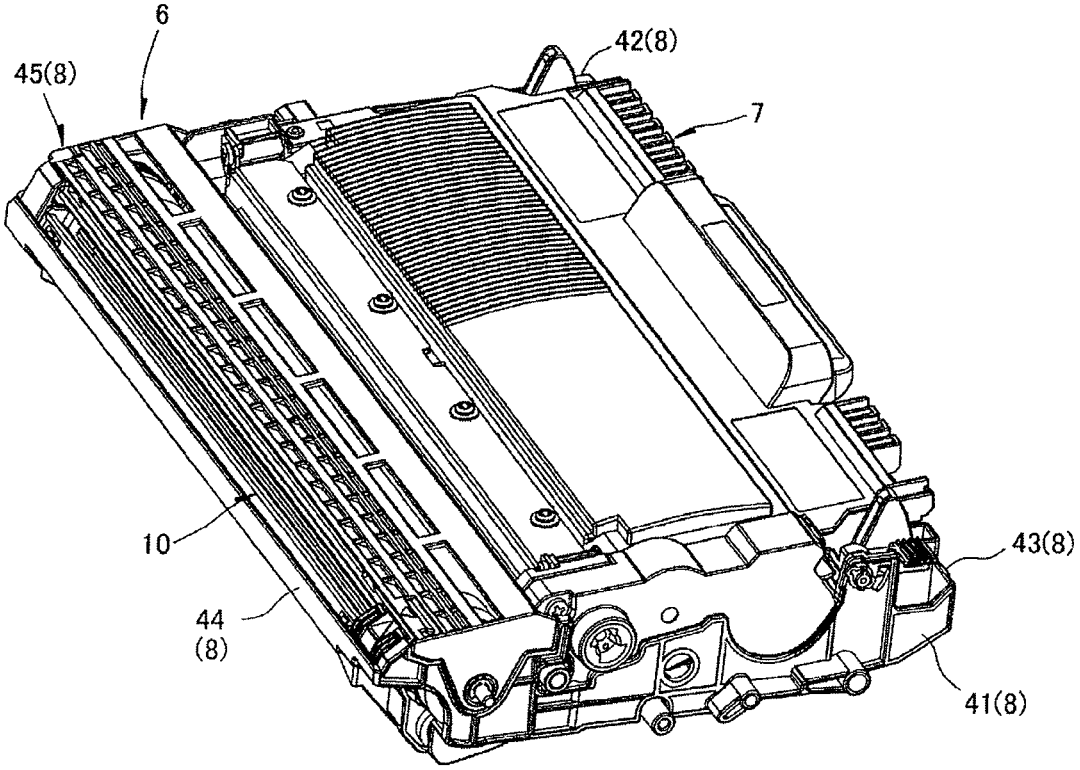

The drum frame 8 of the drum cartridge 6, in one or more example arrangements, is made of plastic. As shown in FIG. 2, the drum frame 8 has a left side wall 41 and a right side wall 42. The left side wall 41 and the right side wall 42 are each shaped like a plate extending lengthwise in the front-to-back direction and are opposed to each other in the lateral direction with a distance therebetween.

A front wall 43 is provided between the individual front ends of the left side wall 41 and the right side wall 42. A rear wall 44 is provided between the individual rear ends of the left side wall 41 and the right side wall 42.

As shown in FIG. 2, an upper wall 45 is provided between the individual rear ends of the left side wall 41 and the right side wall 42 so as to cover them from above.

As shown in FIG. 1, a lower wall 46 is provided between the lower ends of the left side wall 41 and the right side wall 42.

As shown in FIG. 1, the photosensitive drum 9 and the transfer roller 11 are rotatably supported, between the upper wall 45 and the lower wall 46, by the left side wall 41 and the right side wall 42.

The upper wall 45 holds the charging device 10.

Furthermore, a top-open portion that does not face the upper wall 45 in a space sandwiched between the left side wall 41 and the right side wall 42 is the cartridge mount portion 12 (see FIG. 1).

3. Charging Unit (1) Upper Wall

Figure 3:
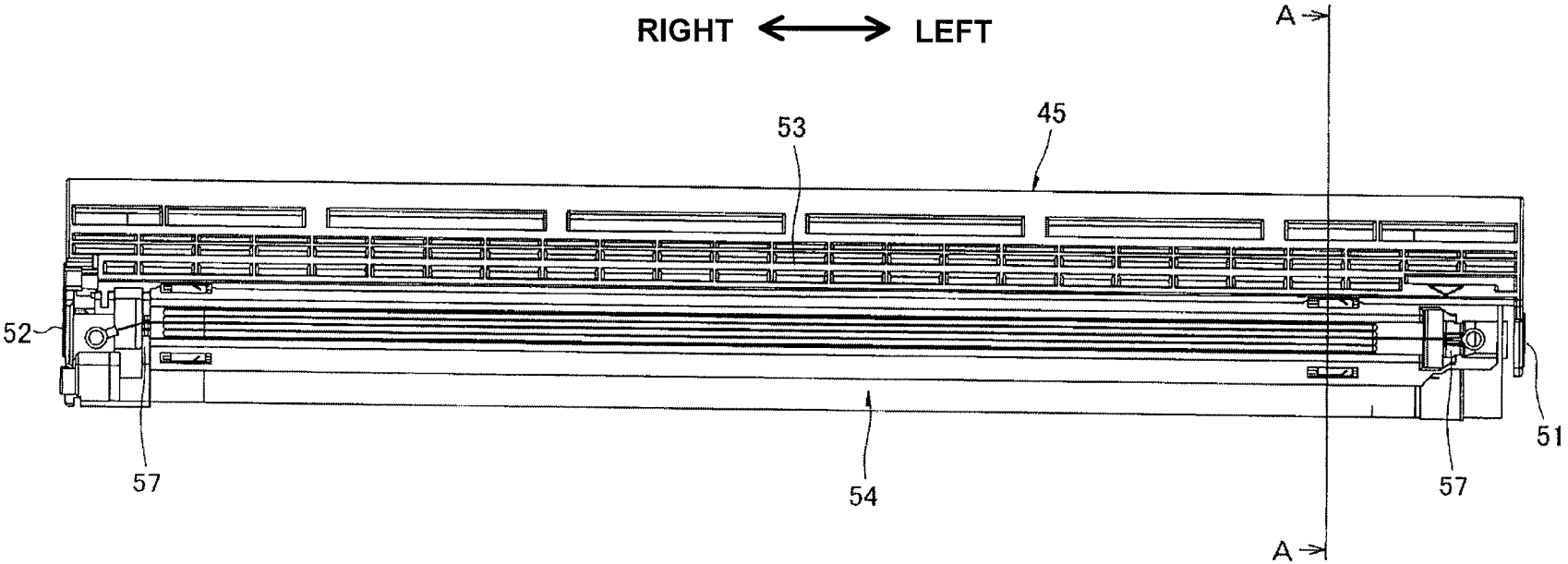
FIG. 3 is a diagram of an upper wall and a charging device shown in FIG. 2, viewed from the upper rear.

As shown in FIGS. 2 and 3, the upper wall 45 has an integrally formed left opposed portion 51 and an integrally formed right opposed portion 52, a covering portion 53, and a charging-device holder 54 as an example of a frame. The charging device 10 and the charging-device holder 54 constitute an example of the charging unit.

The left opposed portion 51 and the right opposed portion 52 have the same substantially triangular shape that is downwardly convex when viewed from the left and right sides. The left opposed portion 51 and the right opposed portion 52 are opposed to each other from outside in the lateral direction to the individual upper rear ends of the left side wall 41 and the right side wall 42.

The covering portion 53 is provided between the upper edges of the left opposed portion 51 and the right opposed portion 52. The covering portion 53 has a grid shape and is formed so as to cover the photosensitive drum 9 from above, with a distance therebetween above the covering portion 53 (see FIG. 1).

Figure 4:
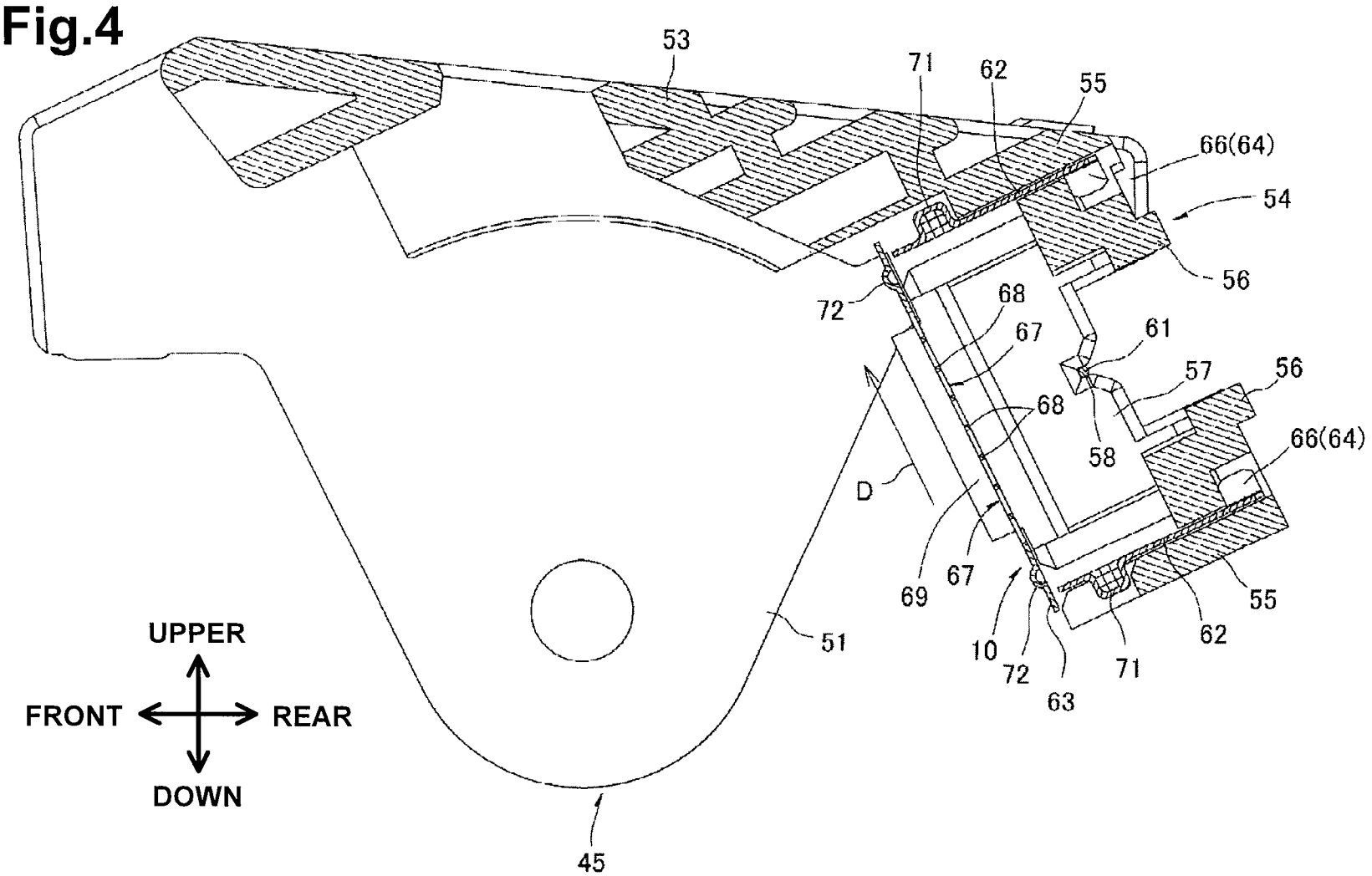
FIG. 4 is a cross-sectional view of the upper wall and the charging device taken along section line A-A shown in FIG. 3.

The charging-device holder 54 is formed at the back of the covering portion 53. As shown in FIGS. 3 and 4, the charging-device holder 54 has a pair of outer supporting portions 55, two pairs of inner supporting portions 56, and a pair of wire supporting portions 57.

The pair of outer supporting portions 55 are shaped like plates extending to the upper rear (lower front) and in the lateral direction and are disposed with a distance therebetween in the direction perpendicular to the upper rear direction.

The pairs of inner supporting portions 56 are disposed inside the pair of outer supporting portions 55 and face the left ends and the right ends of the outer supporting portions 55. Between the inner supporting portions 56 and the outer supporting portions 55, very small distances are provided. The inner supporting portions 56 each have a shape extending from the vicinity of the outer supporting portion 55 to the inside in the opposing direction of the pair of outer supporting portions 55, bending to the upper rear, and then bending again to the upper rear to form a stair-like shape.

As shown in FIG. 3, the pair of wire supporting portions 57 are shaped like plates that are opposed to each other. The distance between the plates may be larger than the lateral width of an image forming region 9A (see FIG. 7) of the surface of the photosensitive drum 9 in which a static latent image is formed. The plates further extend in a direction perpendicular to the lateral direction. As shown in FIG. 4, the wire supporting portions 57 each have a wiring recessed portion 58 at the upper rear end.

(2) Charging Device

The charging device 10 is equipped with a discharge wire 61 as an example of a discharge electrode, a pair of shield electrodes 62 as an example of a counter electrode, and a grid electrode 63 as an example of a counter electrode. Shield electrodes 62 may include a first electrode and a second electrode opposite the first electrode.

The discharge wire 61 is disposed in the wiring recessed portion 58 of the pair of wire supporting portions 57 and extends in a second direction (e.g., the lateral direction) perpendicular to a first direction (e.g., the direction indicated by arrow D in FIG. 4) corresponding to the moving direction of a portion of the surface of the photosensitive drum 9 (see FIG. 1) facing the discharge wire 61 and parallel to the surface of the photosensitive drum 9, with a distance from the surface of the photosensitive drum 9. When a high voltage is applied to the discharge wire 61, corona discharge occurs from the discharge wire 61.

Figure 5:
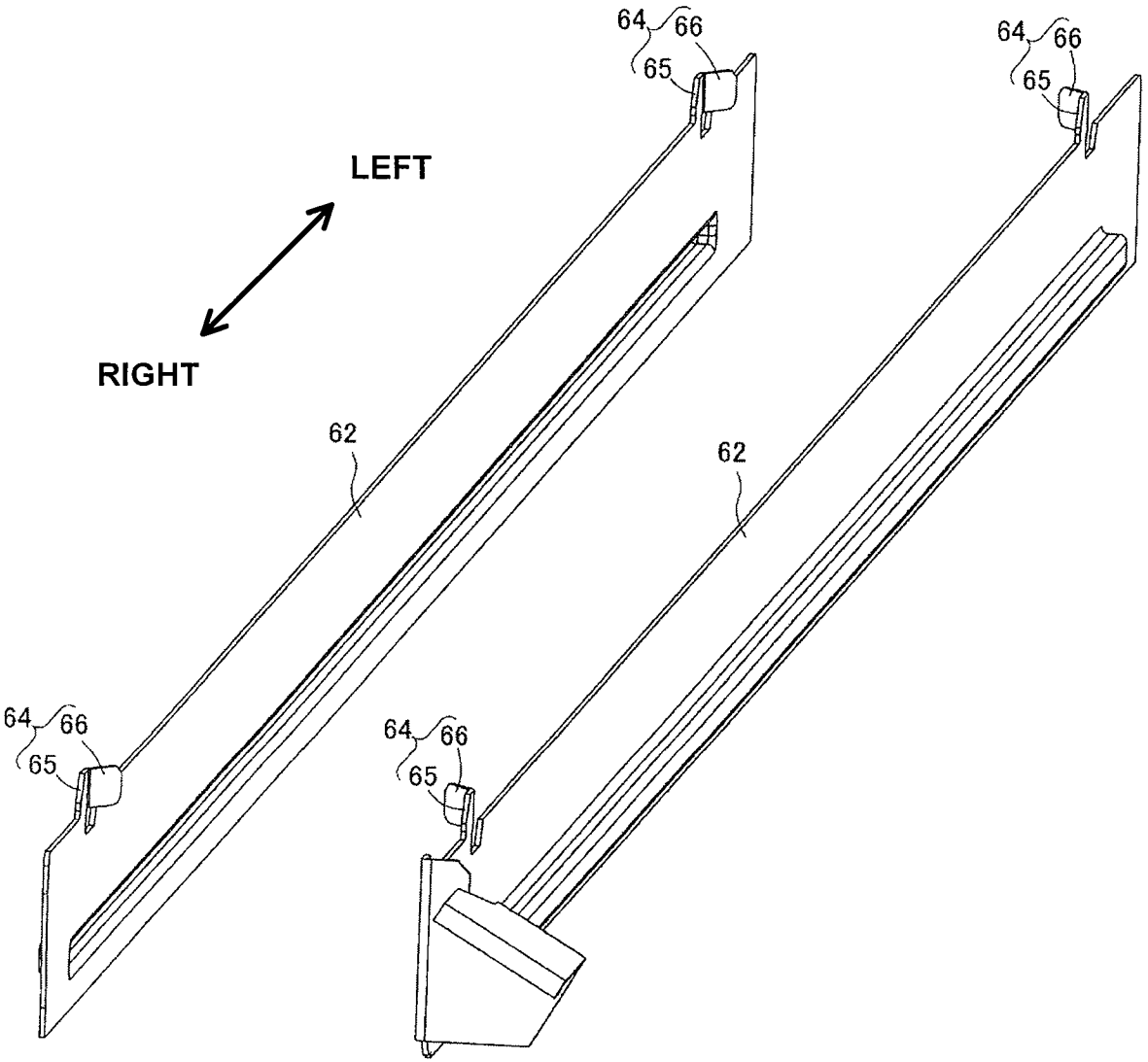
FIG. 5 is a perspective view of shield electrodes shown in FIG. 4.

As shown in FIG. 5, the pair of shield electrodes 62 are formed of thin metal plates each extending in the lateral direction. The left ends and the right ends of the shield electrodes 62 each have a locking claw 64. The locking claw 64 has an integrally formed, long, thin, and substantially triangular projecting portion 65 extending from the upper rear end of the shield electrode 62. A claw portion 66 extends from one end and in the lateral direction of the projecting portion 65 inwardly and in the opposing direction of the pair of shield electrodes 62. As shown in FIG. 4, the shield electrodes 62 are mounted to the charging-device holder 54 such that they are each inserted between the outer supporting portion 55 and the inner supporting portion 56 opposed thereto, and are then slid in the lateral direction. Additionally, as shown in FIGS. 3 and 4, the claw portion 66 of the locking claw 64 is secured to the inner supporting portion 56. In this state, the pair of shield electrodes 62 are disposed at the upstream and the downstream sides in the first direction and extend in parallel to the discharge wire 61, with a distance between the discharge wire 61 and the pair of shield electrodes 62. Providing the pair of shield electrodes 62 can prevent electricity discharged from the discharge wire 61 from leaking to the upstream and the downstream sides in the first direction. For example, a first of shield electrodes 62 may be positioned at an upstream side in the first direction while a second of shield electrodes 62 may be positioned at a downstream side in the first direction.

Figure 6:
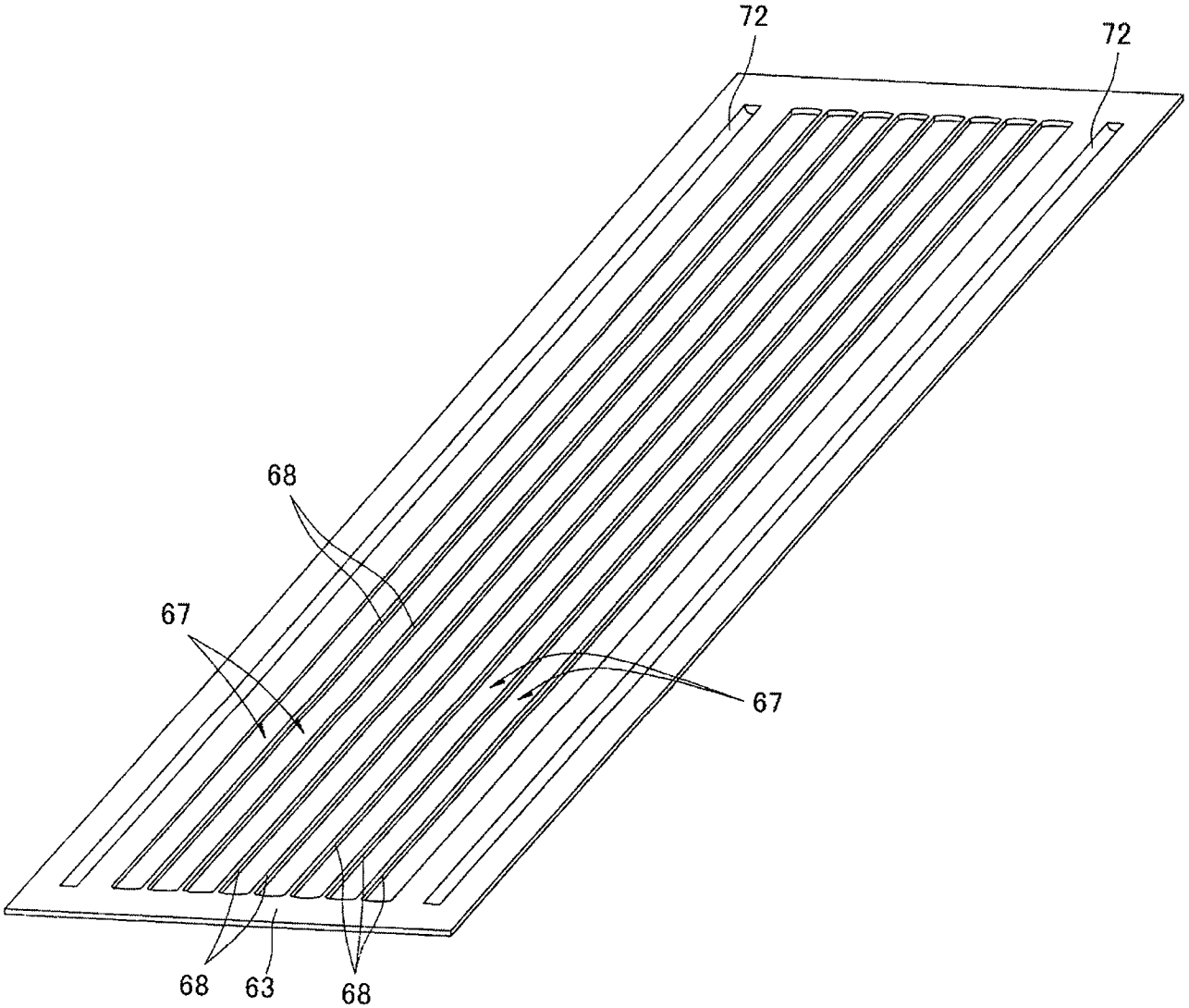
FIG. 6 is a perspective view of a grid electrode shown in FIG. 4.

The grid electrode 63 is a thin metal plate extending in the first direction and in the lateral direction. As shown in FIG. 4, the charging-device holder 54 has a grid holding portion 69 projecting inwardly in the lateral direction from the left opposed portion 51 and the right opposed portion 52 (see FIG. 3). The grid electrode 63 is disposed between the surface of the photosensitive drum 9 and the discharge wire 61, with both ends in the lateral direction supported by the grid holding portion 69 from the photosensitive drum 9 side. As shown in FIG. 6, the grid electrode 63 has a plurality of openings 67, extending length-wise in the longitudinal direction, and width-wise in the direction perpendicular to the longitudinal direction, with a small fixed distance therebetween. Thus, the grid electrode 63 has long thin electrode portions 68 extending in the lateral direction (the second direction) between the individual openings 67. When an appropriate voltage is applied to the grid electrode 63, the amount of electric charge (ions) that reaches the surface of the photosensitive drum 9 from the discharge wire 61 is controlled to be a constant amount.

Figure 7:
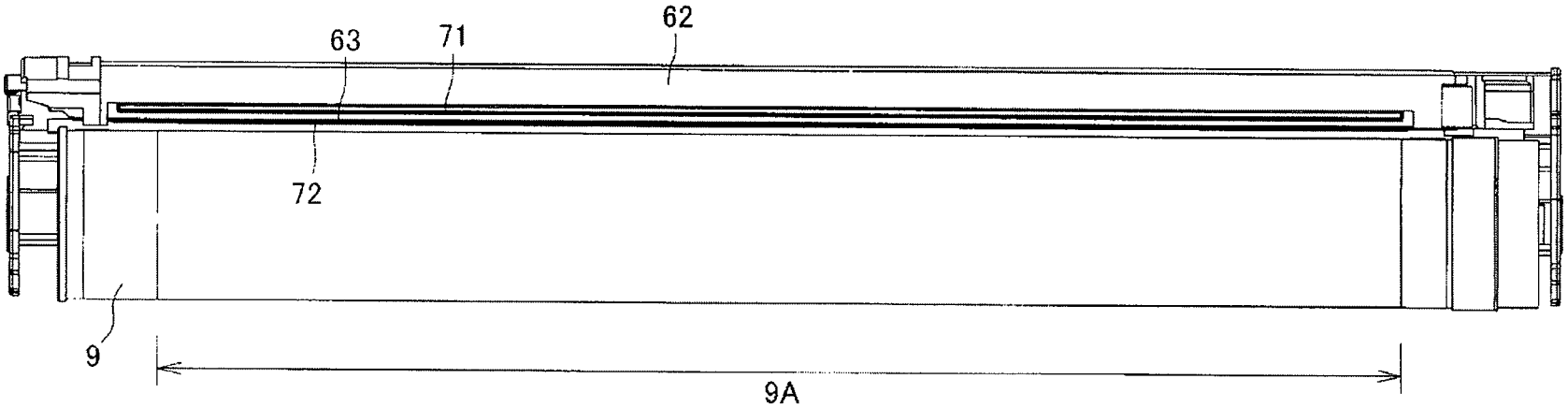
FIG. 7 is a diagram showing the positional relationship between the ribs of the shield electrodes and the grid electrode and the image forming region of a photosensitive drum.

As shown in FIGS. 4 and 5, the shield electrodes 62 have, at the lower front ends (with the exception of the left end and the right end thereof), ribs 71 protruding outward in the opposing direction of the pair of shield electrodes 62. The ribs 71 have a substantially rectangular cross section and, as shown in FIG. 7, extend continuously in the lateral direction for a longer length than the lateral width of the image forming region 9A of the photosensitive drum 9. The rib 71 of one shield electrode 62 and the rib 71 of the other shield electrode 62 are symmetrical to each other in the first direction along an axis extending through a center point of a discharge electrode such as discharge wire 61 and a center of the photosensitive drum 9.

According to one or more arrangements, ribs such as ribs 71 may be formed by at least two bends in a surface of a corresponding electrode (e.g., one or more of shield electrodes 62). In a particular example, one or more of ribs 71 may correspond to a recessed portion in a surface of one or more of electrodes 62, the recessed portion being formed by at least two bends in the corresponding electrode surface. The surfaces of the electrodes 62 may further include a non-recessed portion adjacent or proximate to the recessed portions forming ribs 62.

Furthermore, as shown in FIGS. 4 and 6, the grid electrode 63 has ribs 72 protruding toward the photosensitive drum 9 at positions spaced apart upstream and downstream in the first direction from the plurality of electrode portions 68. Grid electrode may, in one or more arrangements, be provided between the discharge electrode (e.g., discharge wire 61) and the surface of an image bearing member such as photosensitive drum 9. The ribs 72 have a substantially semicircular arc-shaped cross section, and as shown in FIG. 6, have substantially the same length in the lateral direction as the electrode portions 68. In one or more examples, the length of ribs 72 may be less than the length of the electrode. Also as shown in FIG. 7, the ribs 72 extend continuously longer than the lateral width of the image forming region 9A of the photosensitive drum 9. The two ribs 72 are symmetrical to each other in the first direction along an axis extending through a center point of discharge electrode 61 and a center of the photosensitive drum 9.

In one or more arrangements, ribs 72 may correspond to a recessed region in a surface of grid electrode 63. The recessed region may be formed by two or more bends in the surface of the grid electrode 63. The grid electrode 63 may further include a non-recessed region. Ribs 72 (e.g., the recessed portions) may protrude or be concave toward an image bearing member (e.g., photosensitive drum 9). Additionally or alternatively, a length of the recessed portion/ribs 72 of the grid electrode 63 may greater than a width in the second direction of a region of the surface of the image bearing member (e.g., photosensitive drum 9) in which an electrostatic latent image is formed.

Figure 8:
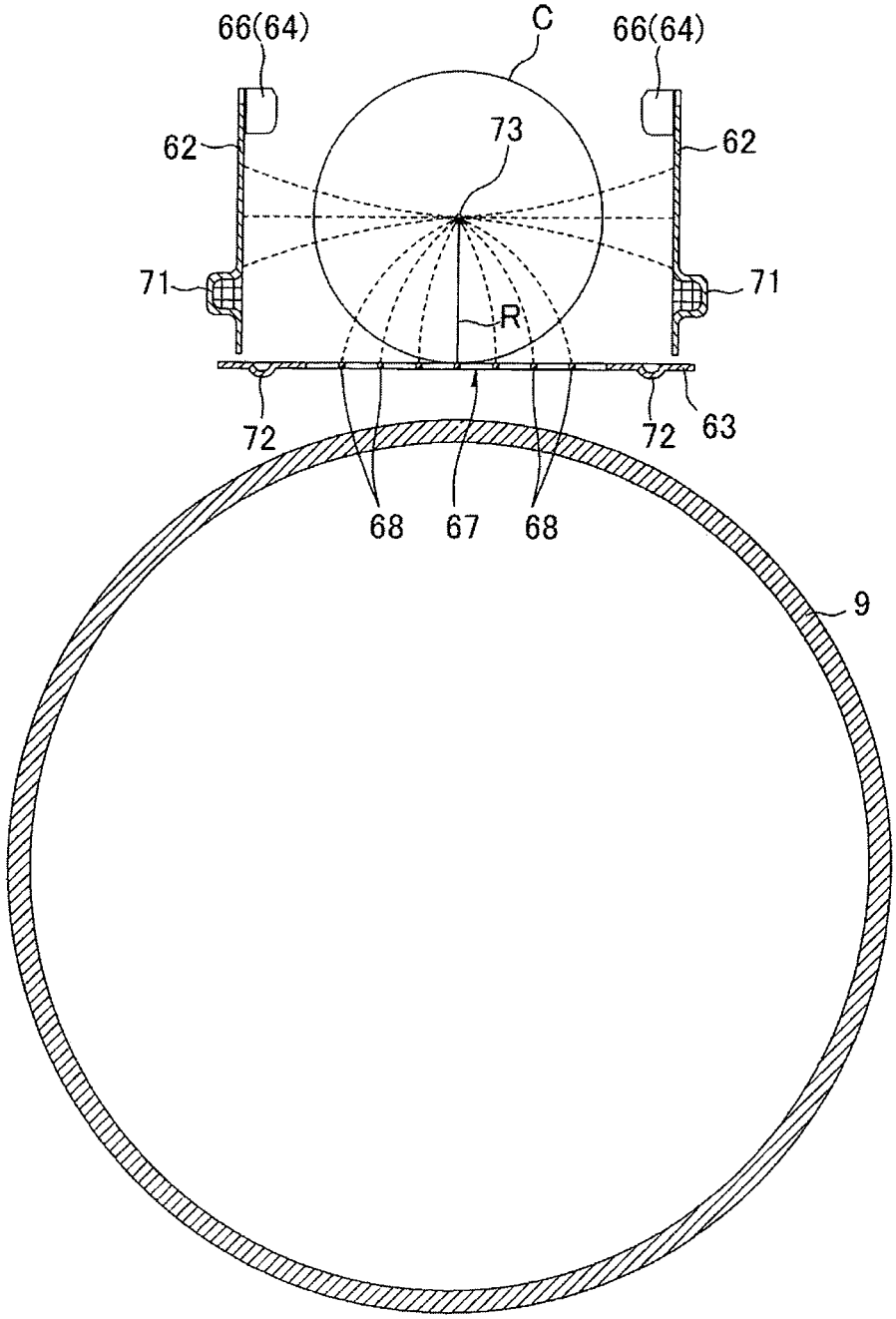
FIG. 8 is a diagram schematically showing the state of discharging from the charging device shown in FIG. 4.

The discharge wire 61 has a circular shape in a cross section perpendicular to the lateral direction. As shown in FIG. 8, assuming that the center of the circular cross section of the discharge wire 61 is a point (discharging portion or discharge electrode) 73 at which discharge occurs in the discharge wire 61, and assuming a circular area C whose radius R is the shortest linear distance between the point (e.g., discharge electrode) 73 and the grid electrode 63, the ribs 71 and 72 (e.g., recessed portions along a surface of the electrode) are located at least outside the circular area C. Preferably, the ribs 71 and 72 are located outside a region where electric charge radiated from the discharge wire 61 can reach (discharge region). A portion where discharge actually occurs in the discharge wire 61 is the peripheral surface of the discharge wire 61.

As described above, the discharge wire 61 extends in the lateral direction (the second direction) perpendicular to the first direction (e.g., the moving direction of the surface of the photosensitive drum 9) and parallel to the surface of the photosensitive drum 9, with a distance from the surface of the photosensitive drum 9. The shield electrodes 62 and the grid electrode 63 are opposed to the discharge wire 61, with a distance therebetween, and extend in the lateral direction.

The shield electrodes 62 and the grid electrode 63 have the ribs 71 and 72 extending in the lateral direction, respectively. Such an arrangement improves the strength of the shield electrodes 62 and the grid electrode 63. Therefore, even if the thicknesses of the shield electrodes 62 and the grid electrode 63 are decreased, decreases in the strength of the shield electrodes 62 and the grid electrode 63 can be compensated by the formation of the ribs. As a result, weight reduction of the charging device 10 can be achieved while the strength of the shield electrodes 62 and the grid electrode 63 is ensured.

Additionally, assuming a circular area C, in a cross section perpendicular to the lateral direction, with the center at the point 73 of the discharge wire 61 at which discharge occurs, and having a radius corresponding to the shortest linear distance between the point 73 and the grid electrode 63, the ribs 71 and 72 are located at least outside the circular area C. This can therefore prevent discharge from the discharging portion of the discharge wire 61 from concentrating onto the ribs. As a result, uniform and efficient charging of the surface of the photosensitive drum 9 can be achieved.

Figure 9:
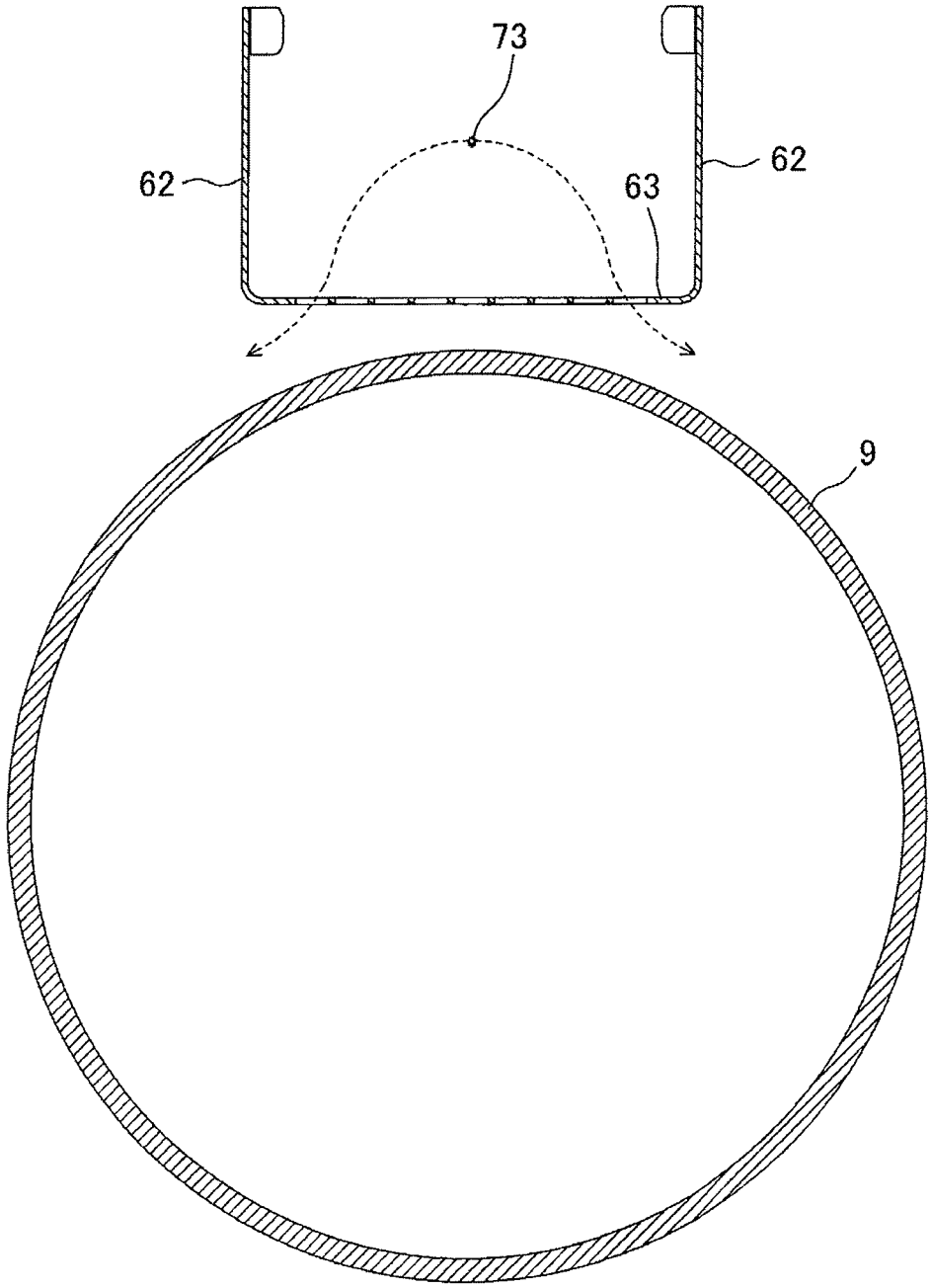
FIG. 9 is a diagram schematically showing an example state in which electric discharge escapes from between the photosensitive drum and a grid electrode in a charging device equipped with a shield electrodes and a grid electrode having no rib.

Moreover, as shown in FIG. 9, with a configuration in which the grid electrode 63 does not include ribs (e.g., ribs 72), there is a risk of electric charge (ions) that has passed between the electrode portions 68 of the grid electrode 63 escaping from between the photosensitive drum 9 and the grid electrode 63 to both sides in the first direction.

When such escape of electric charge occurs, electric charge cannot be supplied stably to a portion of the photosensitive drum 9 facing the grid electrode 63. Furthermore, the surface of the photosensitive drum 9 downstream in the rotating direction of the photosensitive drum 9 relative to a portion facing the grid electrode 63 has an exposure point irradiated with the laser beam from the exposure device 22 (see FIG. 1). Therefore, when electric charge escapes from between the photosensitive drum 9 and the grid electrode 63 to the downstream side in the first direction, the escape electric charge recharges the surface of the exposed photosensitive drum 9 to cause the possibility of decreasing the image quality (print failure). The smaller the process cartridge 5, the closer the portion of the surface of the photosensitive drum 9 facing the grid electrode 63 and the exposure point come, thus increasing the possibility of posing problems due to escape of electric charge.

As shown in FIG. 8, since the grid electrode 63 has the ribs 72, and the ribs 72 protrude toward the photosensitive drum 9, electric charge can be prevented from escaping from between the photosensitive drum 9 and the grid electrode 63 in the first direction. This allows electric charge to be supplied stably to the surface of the photosensitive drum 9 and prevents occurrence of problems due to escape of electric charge.

Additionally, since the strength of the grid electrode 63 is ensured, deflective deformation of the electrode portions 68 can be prevented even with a configuration having a plurality of electrode portions 68. As a result, contact between the electrode portions 68 and the photosensitive drum 9 can be prevented. The ribs 71 and 72 are formed not across the overall lateral width of the shield electrodes 62 and the grid electrode 63 but at portions thereof, respectively. Thus, the ribs 71 and 72 are open only at the surfaces opposite to the protruding sides and are closed at the left end faces and the right end faces. This allows the shapes of the ribs 71 and 72 to be held fixed, thus further improving the strength of the shield electrodes 62 and the grid electrode 63.

According to another aspect, the ribs 71 and 72 extend continuously longer than the lateral width of the image forming region 9A of the surface of the photosensitive drum 9. This can prevent the deformation of the portions of the shield electrodes 62 and the grid electrode 63 facing the image forming region 9A. As a result, more uniform charging of the image forming region 9A can be achieved.

Still further, in arrangements where the rib 71 of one shield electrode 62 and the rib 71 of the other shield electrode 62 are symmetrical to each other in the first direction along an axis extending through a center of the point or discharge electrode 73 and a center of the photosensitive drum 9. Furthermore, the two ribs 72 of the grid electrode 63 are symmetrical to each other in the first direction as described above. Therefore, even if the ribs 71 and 72 are formed in the discharge region, electric lines of force drawn in the discharge region are symmetrical in the first direction (as described). Thus, uniform charging of the surface of the photosensitive drum 9 can be achieved.

Figure 10:
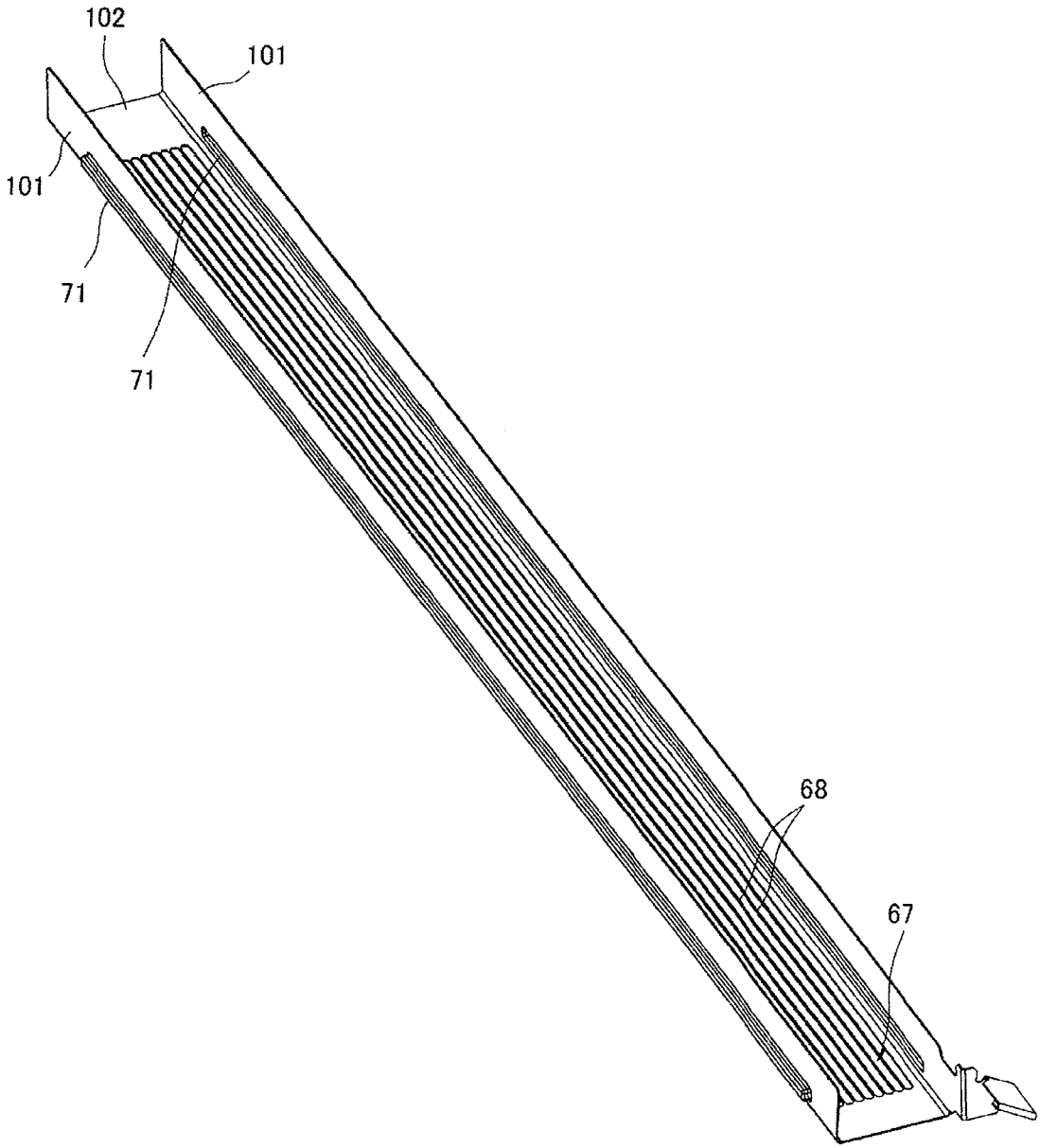
FIG. 10 is a perspective view of shield electrodes and an example grid electrode according to one or more aspects described herein.
Figure 11:
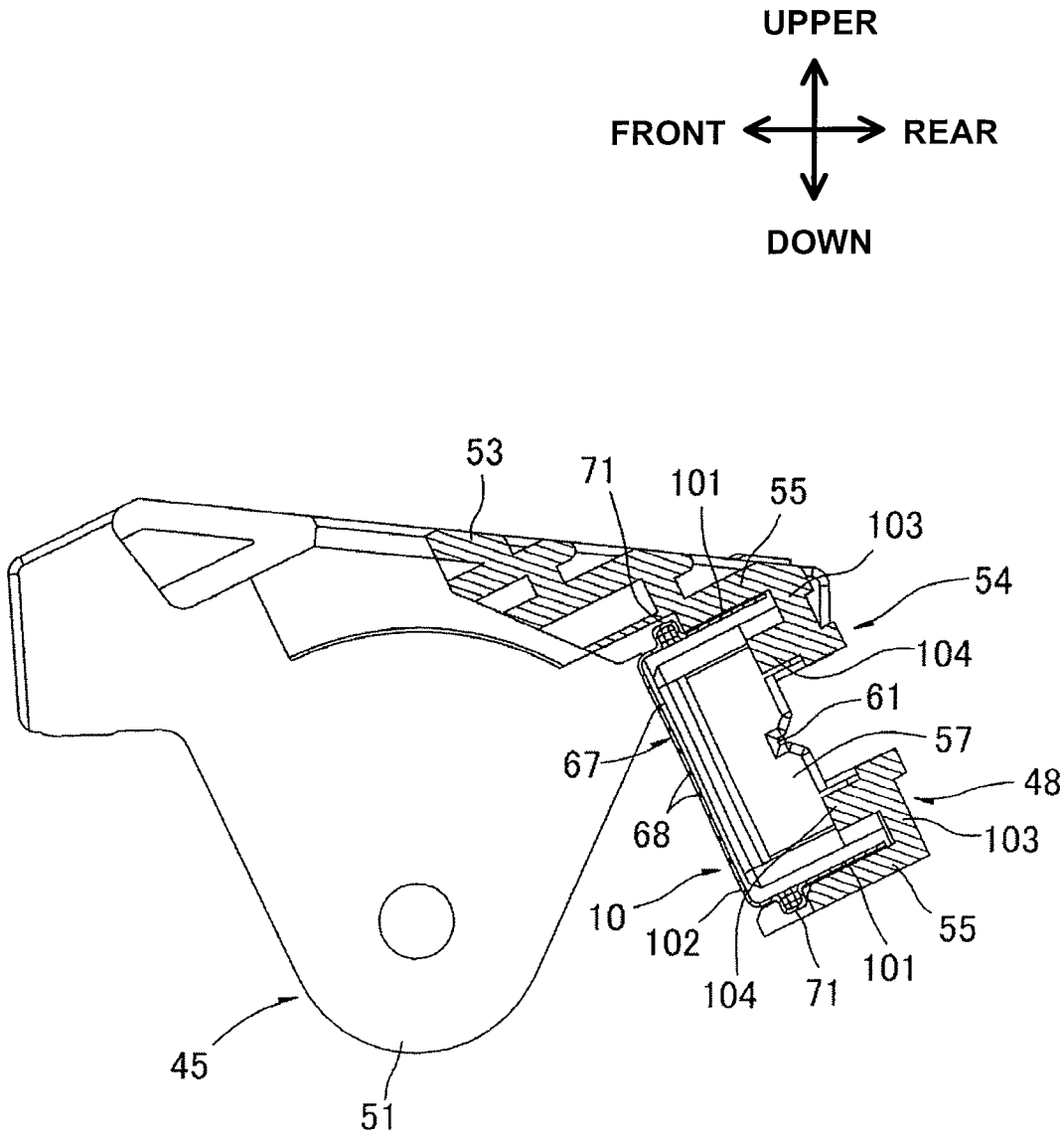
FIG. 11 is a cross-sectional view of a charging device equipped with the shield electrodes and the grid electrode shown in FIG. 10 and an upper wall.

As shown in FIG. 11, shield electrodes 101 and a grid electrode 102 shown in FIG. 10 can be substituted for the shield electrodes 62 and the grid electrode 63 shown in FIG. 4.

Differences between the configurations of the shield electrodes 101 and the grid electrode 102, and the shield electrodes 62 and the grid electrode 63 will be described. Descriptions of portions given the same reference signs in FIGS. 10 and 11 as those of the portions shown in FIGS. 5 and 6 are omitted. Furthermore, for the configuration of the charging-device holder 54 shown in FIG. 11, differences from the configuration of the charging-device holder 54 shown in FIG. 4 will be described, and descriptions of portions given the same reference signs in FIG. 11 as those of the portions shown in FIG. 4 are omitted.

As shown in FIG. 10, the shield electrodes 101 and the grid electrode 102 are integrally formed. The grid electrode 102 does not include portions corresponding to the ribs 72 shown in FIG. 6.

As shown in FIG. 11, the charging-device holder 54 integrally includes a pair of outer supporting portions 55, connecting portions 103 extending inward in the opposing direction of the pair of outer supporting portions 55 from the upper rear ends of the outer supporting portions 55, and inner supporting portions 104 extending, in parallel, from the ends of the individual connecting portions 103, with a distance from the outer supporting portions 55.

The upper rear portions of the shield electrodes 101 relative to the ribs 71 are inserted between the outer supporting portions 55 and the inner supporting portions 104, and the shield electrodes 101 are held by the charging-device holder 54, with the upper rear portions in contact with the outer supporting portions 55. Such a configuration may also provide one or more of the advantages described herein.

Figure 12:
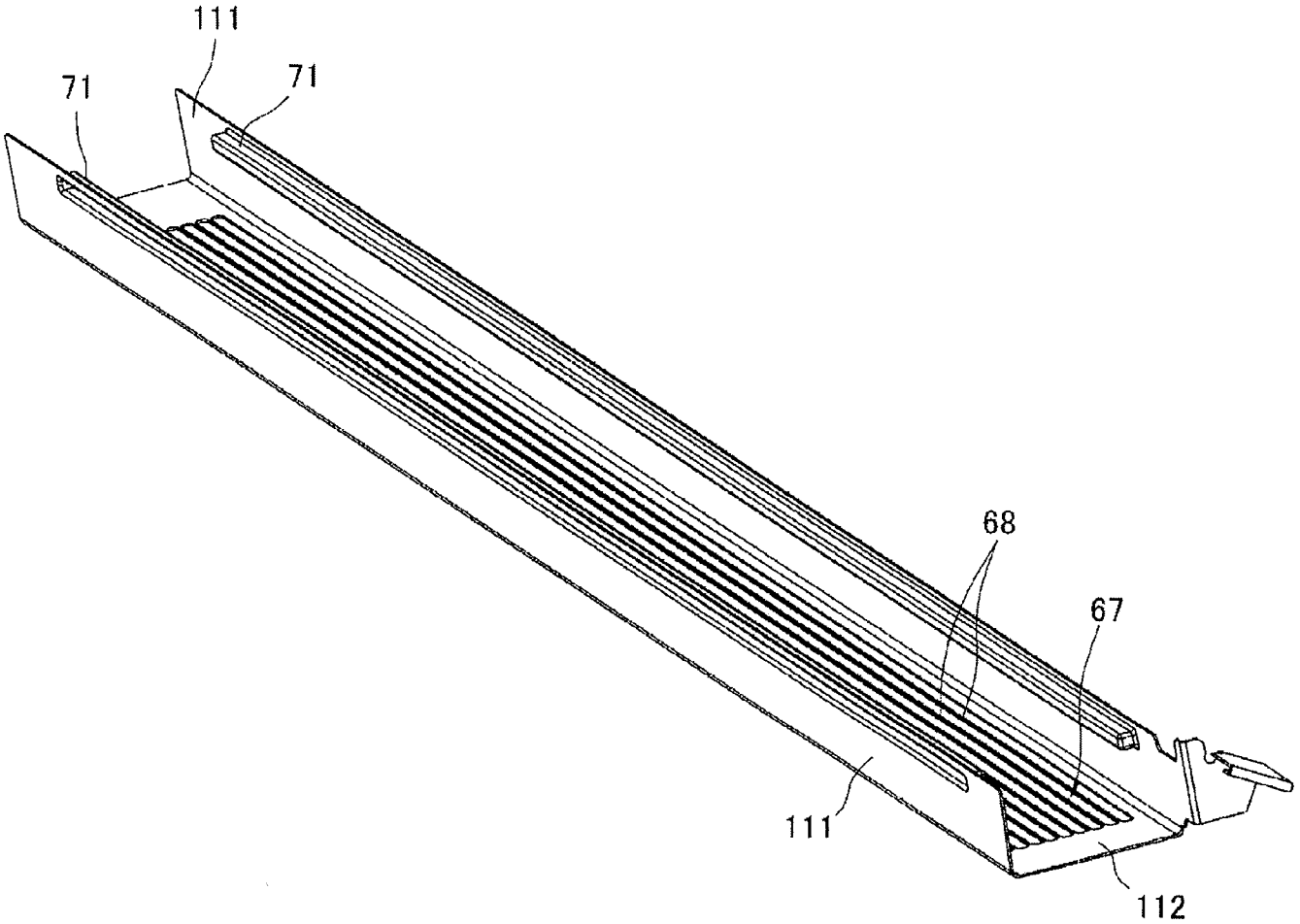
FIG. 12 is a perspective view of shield electrodes and an example grid electrode according to one or more aspects described herein.
Figure 13:
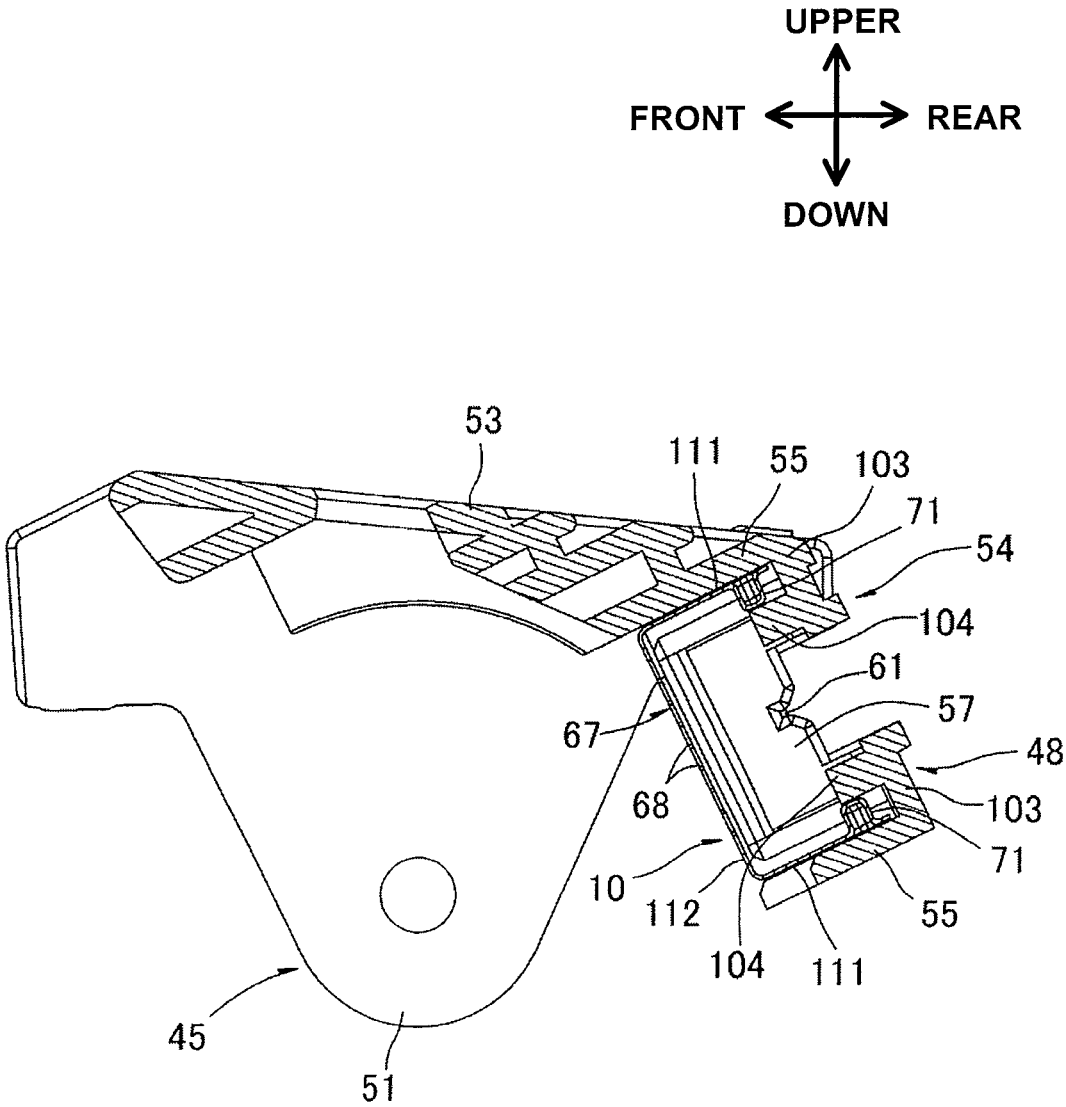
FIG. 13 is a cross-sectional view of a charging device equipped with the shield electrodes and the grid electrode shown in FIG. 12 and an upper wall.

FIG. 13 illustrates another example configuration. As shown in FIG. 13, shield electrodes 111 and a grid electrode 112 shown in FIG. 12 can be substituted for the shield electrodes 101 and the grid electrode 102 shown in FIG. 11.

Hereinafter, differences between the configurations of the shield electrodes 111 and the grid electrode 112, and the shield electrodes 101 and the grid electrode 102 will be described, and descriptions of portions given the same reference signs in FIGS. 12 and 13 as those of the portions shown in FIGS. 10 and 11 are omitted. The configuration of the charging-device holder 54 shown in FIG. 13 may be the same as the configuration of the charging-device holder 54 shown in FIG. 11.

As shown in FIG. 12, the ribs 71 are formed at the upper rear ends of the shield electrodes 111 and protrude inward in the opposing direction of the pair of shield electrodes 111.

The ribs 71 of the shield electrodes 111 are inserted between the outer supporting portions 55 and the inner supporting portions 104 as an example of a holding unit, and the ribs 71 are held by the outer supporting portions 55 and the inner supporting portions 104, so that the shield electrodes 111 are held by the charging-device holder 54, with the shield electrodes 111 in contact with the outer supporting portions 55.

Advantages described above may also be achieved using such a configuration. Furthermore, since the ribs 71 have a certain thickness in the opposing direction of the pair of shield electrodes 111, the outer supporting portions 55 and the inner supporting portions 104 that hold the ribs 71 can be formed, even if molded, with high dimensional accuracy. This allows the ribs 71 to be held stably by the outer supporting portions 55 and the inner supporting portions 104. Furthermore, since the upper rear ends of the shield electrodes 111 are held, the shield electrodes 111 can be prevented from falling down in the opposing direction. As a result, deflective deformation of the electrode portions 68 of the grid electrode 112 can be further prevented, and thus, contact between the electrode portions 68 and the photosensitive drum 9 can be prevented.

Figure 14:
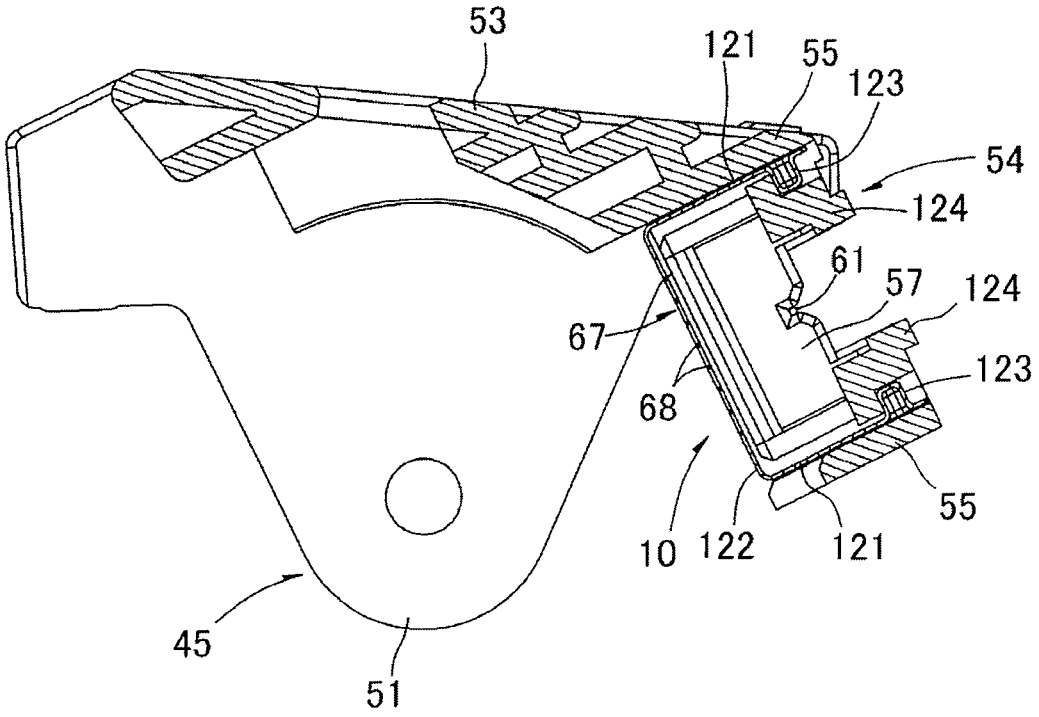
FIG. 14 is a cross-sectional view of an upper wall and a charging device according to one or more aspects described herein.

According to yet another example configuration, shield electrodes 121 and a grid electrode 122 shown in FIG. 14 can be substituted for the shield electrodes 62 and the grid electrode 63 shown in FIG. 4.

Hereinafter, differences between the configurations of the shield electrodes 121 and the grid electrode 122, and the shield electrodes 62 and the grid electrode 63 will be described, and descriptions of portions given the same reference signs in FIG. 14 as those of the portions shown in FIG. 4 are omitted. Furthermore, for the configuration of the charging-device holder 54 shown in FIG. 14, differences from the configuration of the charging-device holder 54 shown in FIG. 4 will be described, and descriptions of portions given the same reference signs in FIG. 14 as those of the portions shown in FIG. 4 are omitted.

Figure 15A:
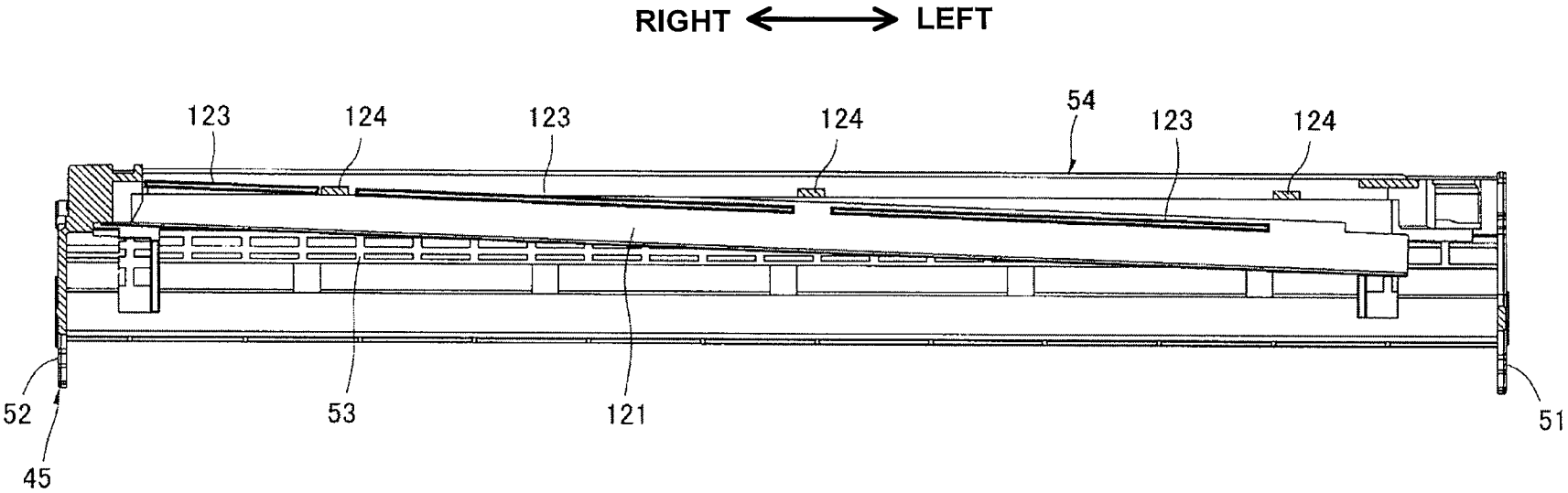
FIG. 15A is a diagram showing an initial state in which shield electrodes and a grid electrode shown in FIG. 14 are mounted to the upper wall.
Figure 15B:
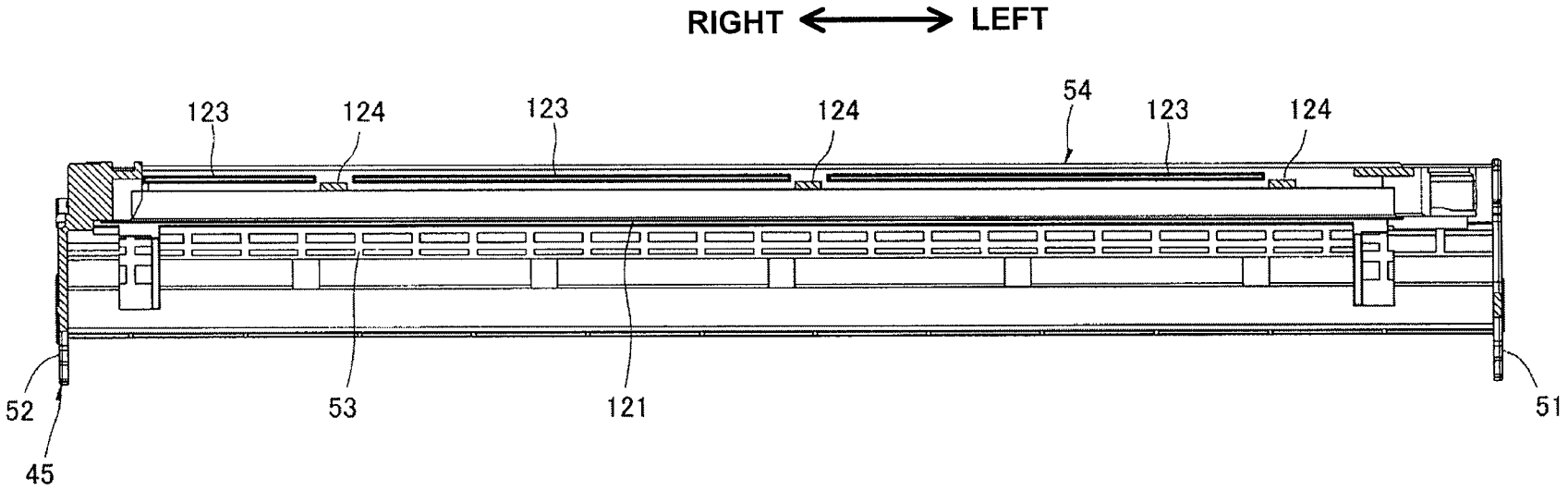
FIG. 15B is a diagram showing an intermediate state in which the shield electrodes and the grid electrode shown in FIG. 14 are mounted to the upper wall.
Figure 15C:
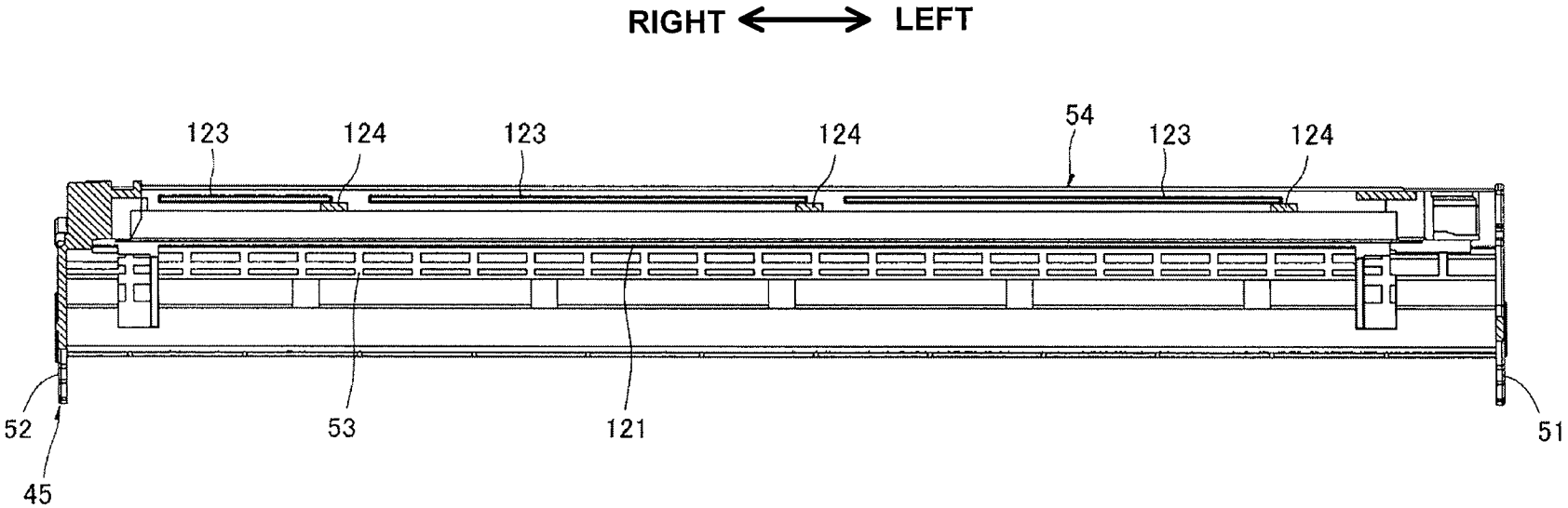
FIG. 15C is a diagram showing a state in which the shield electrodes and the grid electrode shown in FIG. 14 are mounted to the upper wall.

As shown in FIG. 14, the shield electrodes 121 and the grid electrode 122 are integrally formed. As shown in FIGS. 15A to 15C, the upper rear ends of the shield electrodes 121 are each provided with three ribs 123 protruding inward in the opposing direction of the pair of shield electrodes 121. The three ribs 123 are disposed on the same straight line, with a distance therebetween in the lateral direction, and extend in the lateral direction. The rib 123 at the left end and the rib 123 at the center have the same length in the lateral direction. The rib 123 at the right end is shorter in the lateral direction than the ribs 123 at the left end and at the center. The relative lengths of the rib 123 at the right end and at the left end may aid in installation (e.g., in correct direction). The ribs 123 are substantially rectangular in cross section. As shown in FIG. 14, the grid electrode 122 does not include portions corresponding to the ribs 72 shown in FIG. 6.

As shown in FIGS. 15A to 15C, the charging-device holder 54 has three positioning portions 124 disposed inside the pair of outer supporting portions 55. The three positioning portions 124 align in the lateral direction, with a distance between each being a little longer than the lateral length of the ribs 123 at the left end and at the center therebetween. The lateral sizes of the individual positioning portions 124 are smaller than the lateral distances between the ribs 123. Between the positioning portions 124 and the outer supporting portions 55, small spaces are left. The positioning portions 124 each have a cross-sectional shape extending from the vicinity of the outer supporting portion 55 inward in the opposing direction of the pair of outer supporting portions 55, bending to the upper rear, bending inward in the opposing direction, and further bending to the upper rear.

The shield electrodes 121 and the grid electrode 122 are mounted to the charging-device holder 54 by the method shown in FIGS. 15A to 15C. Specifically, as shown in FIG. 15A, first, the shield electrodes 121 and the grid electrode 122 are disposed such that the right-end and central positioning portions 124 are opposed between the three ribs 123 of the shield electrodes 121. Next, as shown in FIG. 15B, the individual shield electrodes 121 are inserted between the outer supporting portions 55 and the positioning portions 124 in such a manner that the right-end and central positioning portions 124 pass between the three ribs 123 of the shield electrodes 121. Then, the shield electrodes 121 and the grid electrode 122 are slid to the left, so that the individual ribs 123 are brought into contact with the positioning portions 124 from the upper rear (a third direction perpendicular to the first direction and the second direction) to be locked, as shown in FIG. 15C, and thus, the shield electrodes 121 and the grid electrode 122 are mounted to the charging-device holder 54. Since the ribs 123 come into contact with the positioning portions 124 from the upper rear, the shield electrodes 121 and the grid electrode 122 are positioned in the contact direction (e.g., the third direction). As a result, the surface of the photosensitive drum 9 (see FIG. 1) and the grid electrode 122 can be spaced at a fixed distance with high accuracy. Thus, further uniform charging of the surface of the photosensitive drum 9 can be achieved.

The ribs 123 of one shield electrodes 121 and the ribs 123 of the other shield electrodes 121 are symmetrical to each other in the first direction (see FIG. 4) (e.g., symmetrical along an axis extending through a center of the point or discharge electrode 73 and a center of the photosensitive drum 9). Therefore, the shield electrodes 121 and the grid electrode 122 can be positioned with high accuracy without unbalance in the first direction.

Figure 16:
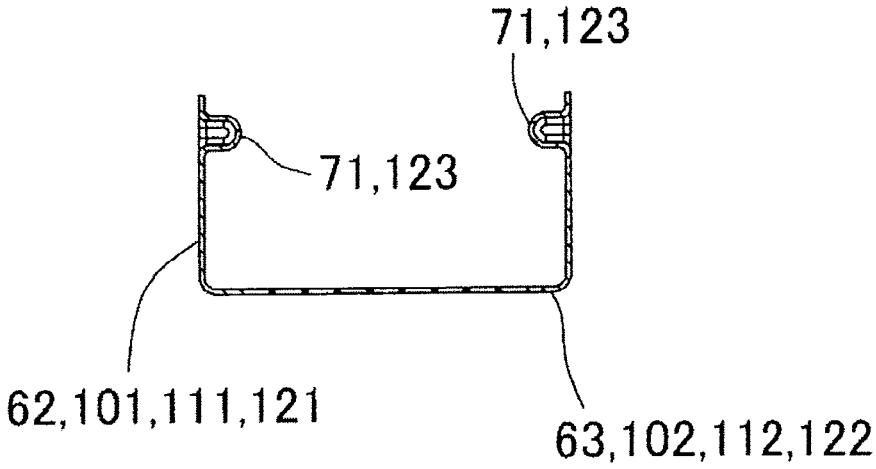
FIG. 16 is a cross-sectional view showing another cross-sectional shape (substantially U-shape) of the ribs shown in FIG. 4.
Figure 17:
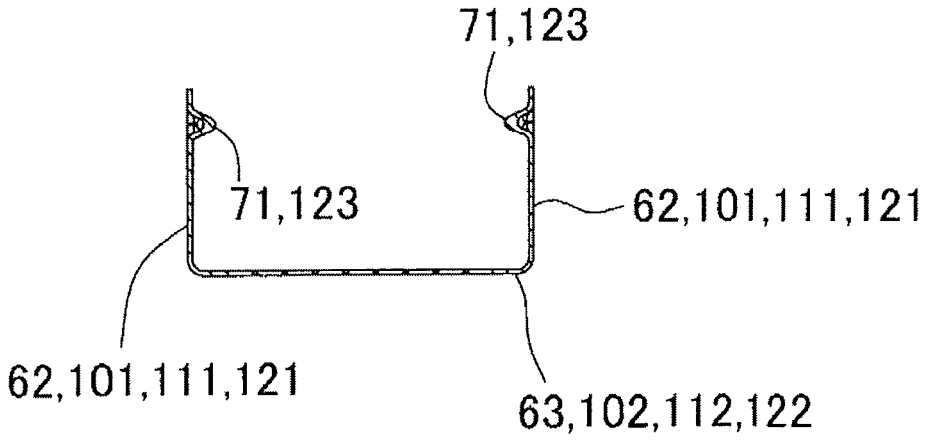
FIG. 17 is a cross-sectional view showing yet another cross-sectional shape (substantially V-shape) of the ribs shown in FIG. 4.

According to one or more arrangements, ribs 71 and 123 may be U-shaped in cross section, as shown in FIG. 16. Alternatively, the ribs 71 and 123 may be substantially V-shaped in cross section, as shown in FIG. 17.

Still further, in some arrangements, the ribs 72 may be substantially rectangular in cross section, U-shaped in cross section, or alternatively, substantially V-shaped in cross section.

In some examples, a photosensitive belt may be employed instead of the photosensitive drum 9 as an image bearing member.

Figure 18:
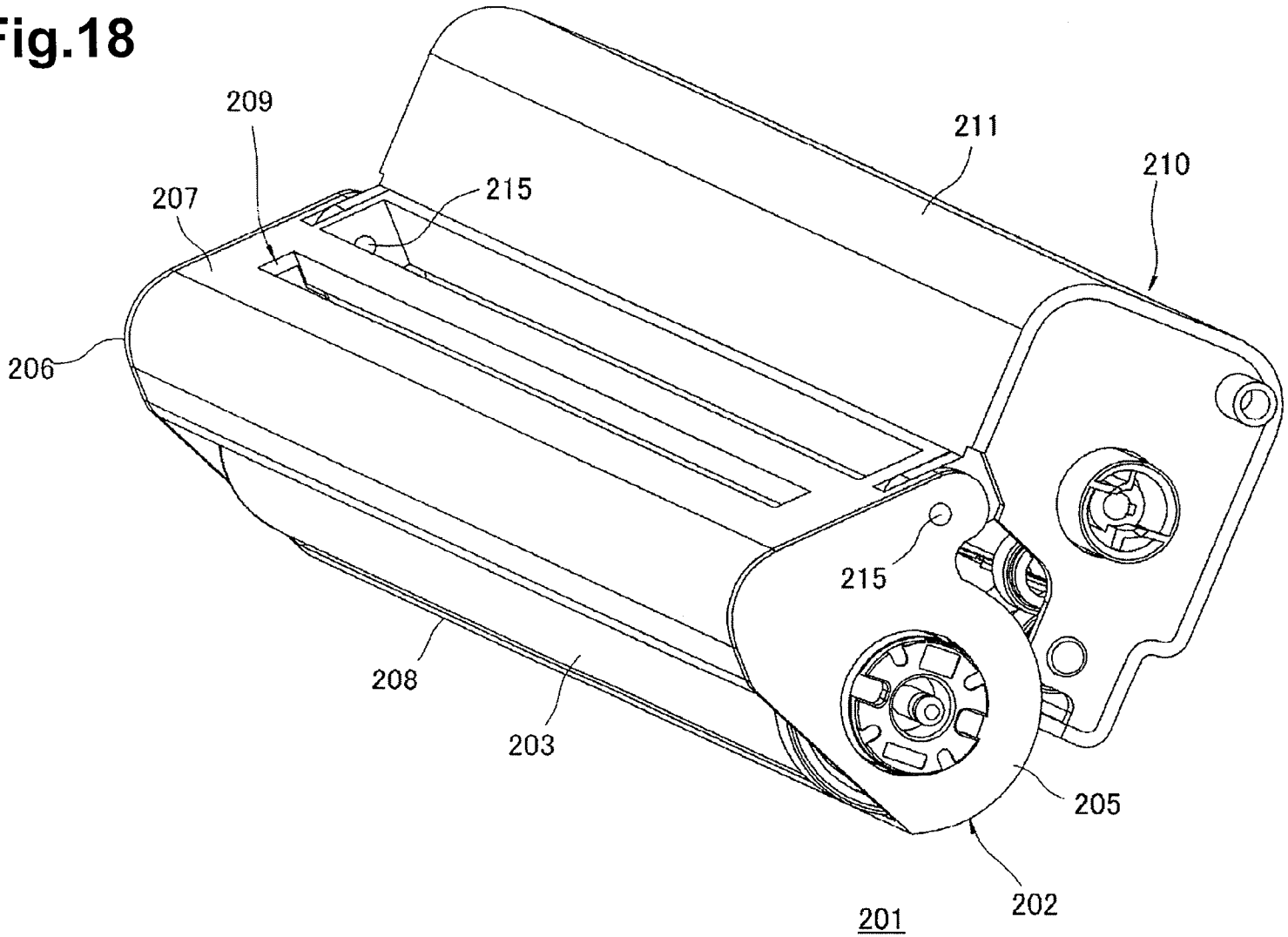
FIG. 18 is a perspective view of a process cartridge in another example configuration.
Figure 19:
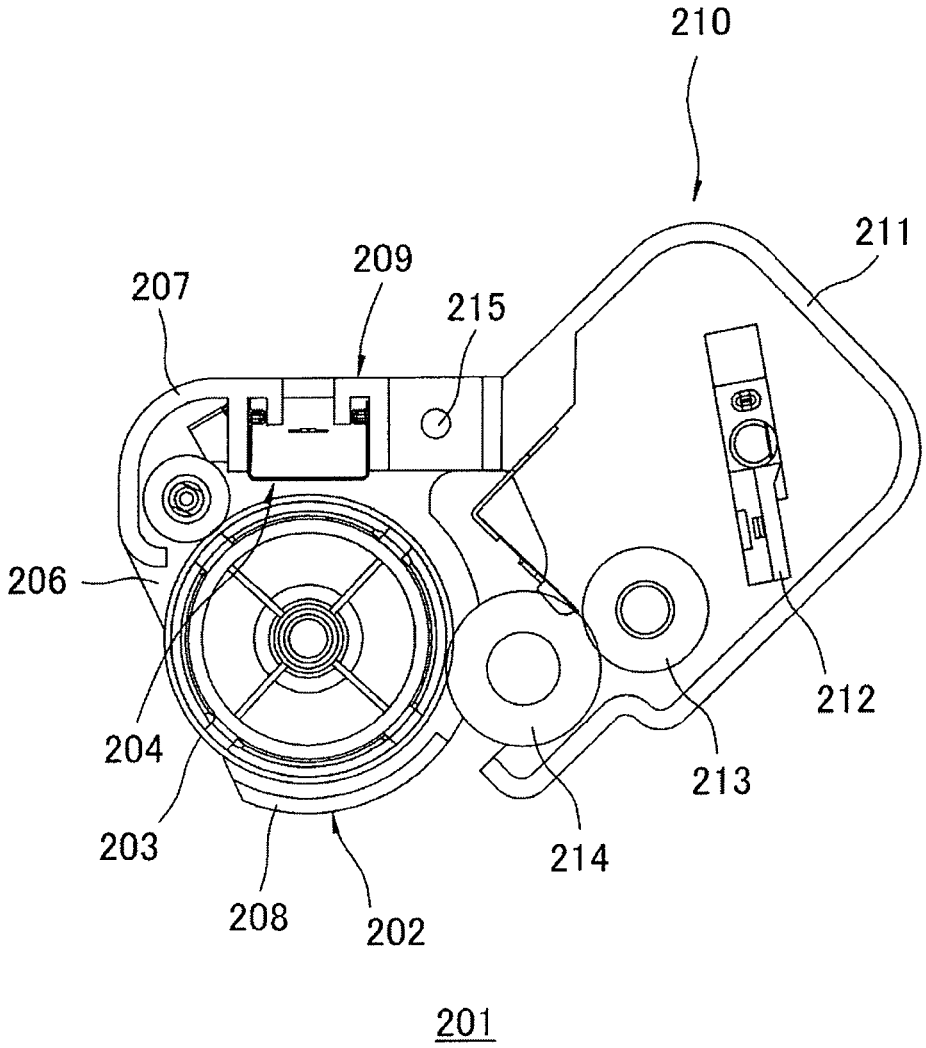
FIG. 19 is a cross-sectional view of the process cartridge shown in FIG. 18.

Additionally, a process cartridge 201 shown in FIGS. 18 and 19 may be employed instead of the process cartridge 5 shown in FIG. 1.

The process cartridge 201 is equipped with a drum frame 202. The drum frame 202 holds a photosensitive drum 203 as an example of an image bearing member and a charging device 204. Specifically, the drum frame 202 has a pair of side walls 205 and 206 opposed to each other, an upper wall 207 provided between the upper ends of the side walls 205 and 206, and a lower wall 208 provided between the lower ends of the side walls 205 and 206. The photosensitive drum 203 is rotatably held by the side walls 205 and 206. The upper wall 207 has a charging-device holder 209 as an example of a frame, and the charging device 204 is held by the charging-device holder 209. The charging device 10 and the charging-device holder 209 constitute an example of the charging unit.

The process cartridge 201 further includes a developing unit 210. The developing unit 210 has a casing 211 for accommodating toner. The casing 211 holds an agitator 212, a supply roller 213, a developing roller 214 and so on. The developing roller 214 is disposed such that part of the surface (peripheral surface) thereof is exposed from the casing 211. The casing 211 is rotatably joined to the drum frame 202 with a support shaft 215 as the fulcrum so that the surface of the developing roller 214 can come into/out of contact with the surface of the photosensitive drum 203.

In this process cartridge 201, the configurations of the charging device 10 and the charging-device holder 54 described above can be employed as the configurations of the charging device 204 and the charging-device holder 209.

According to additional or alternative arrangements, instead of the discharge wire 61, a plurality of needle electrodes arrayed in the lateral direction may be employed. In this case, the end points of the individual needle electrodes serve as discharging portions.

Figure 20:
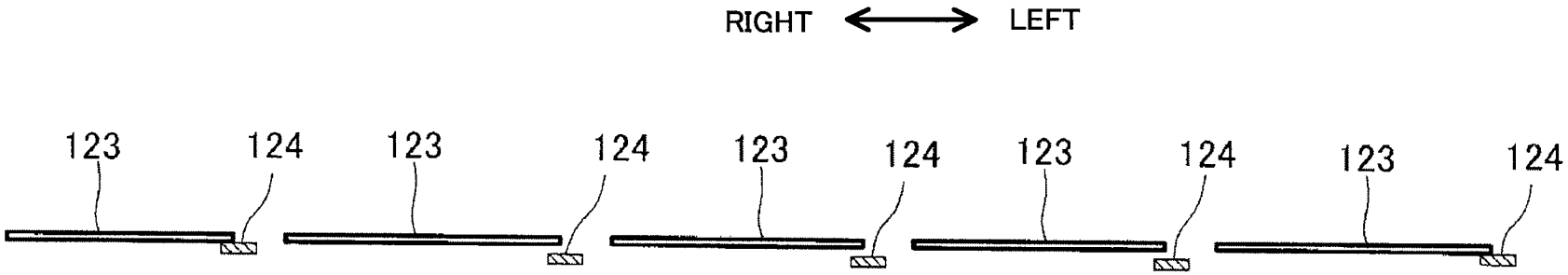
FIG. 20 is a cross-sectional view showing another example configuration of the ribs and the positioning portions.

In yet other alternate or additional arrangements, more ribs 123 and/or positioning portions 124 may be provided. For example, as shown in FIG. 20, five ribs 123 may be provided in the same straight line extending in the lateral direction, with a distance therebetween, and five positioning portions 124 may be correspondingly provided between the five ribs 123.

The positioning portions 124 at both ends in the lateral direction may be, in some examples, provided at positions higher to the upper rear relative to the central three positioning portions 124. This allows the ribs 123 at both ends in the lateral direction to be locked in contact with the positioning portions 124, so that the central three ribs 123 are spaced apart from the positioning portions 124.

In the case where the numbers of ribs 123 and positioning portions 124 are large, it is difficult to bring the individual ribs 123 into contact with the positioning portions 124 due to the dimensional errors of the portions. This may pose a risk that the shield electrodes 121 may wobble (see FIG. 15C). With the configuration in which only the ribs 123 at both ends in the lateral direction are brought into contact with the positioning portions 124, the ribs 123 can be brought into contact with the positioning portions 124 even if the portions have some dimensional errors. Thus, the shield electrodes 121 can be stably positioned. Furthermore, even if the ribs 123 at both ends in the lateral direction come off the positioning portions 124, the central three ribs 123 come into contact with the positioning portions 124 to be locked, and thus, falling-off of the shield electrodes 121 can be prevented.

Aspects of the present disclosure can be applied to general discharging units that generate corona discharge, including not only a charging unit for uniformly charging the photosensitive drum 9 or 203 but also a transfer unit for transferring a toner image formed on the photosensitive drum 9 or 203 onto paper by discharging toward the photosensitive drum 9 or 203.

Although the monochrome laser printer 1 is taken as an example of an image forming apparatus equipped with the charging unit (discharging unit) described herein, the charging unit (discharging unit) may be provided in a color laser printer or other image forming apparatuses.

Furthermore, various design changes may be made in the above-described configuration within the scope of the claims.

The invention claimed is:

1. A charging unit configured to charge a surface of an image bearing member moving in a first direction, the charging unit comprising:

a discharge electrode extending in a second direction perpendicular to the first direction and parallel to the surface of the image bearing member, wherein the discharge electrode is spaced apart from the surface of the image bearing member;

a first shield electrode; and a second shield electrode disposed opposite to the first shield electrode, a surface of the second shield electrode including a first recessed portion and a first non-recessed portion, the first recessed portion being formed by at least two bends in the surface of the second shield electrode, wherein one of the first shield electrode and the second shield electrode is located at an upstream side of the discharge electrode in the first direction, and the other one of the first shield electrode and the second shield electrode is located at a downstream side of the discharge electrode in the first direction, and wherein a length of the first recessed portion in the second direction is less than an entire length of the second shield electrode in the second direction, the first recessed portion being enclosed by the first non-recessed portion at both ends in the second direction.

2. The charging unit according to claim 1, further comprising:

a frame configured to support the first and second shield electrodes, wherein the frame has a holder configured to hold the first recessed portion of the second shield electrode.

3. The charging unit according to claim 2, wherein the frame includes positioning portions configured to contact the first recessed portion from at least one side of a third direction perpendicular to both the first direction and the second direction, wherein the positioning portions are further configured to position the second shield electrode in the third direction.

4. The charging unit according to claim 3, wherein the second shield electrode includes a plurality of first recessed portions, the plurality of first recessed portions being spaced apart from one another in the second direction.

5. The charging unit according to claim 4, wherein the positioning portions are spaced apart from one another, wherein a distance between the positioning portions is longer than the length of one of the plurality of first recessed portions in the second direction.

6. The charging unit according to claim 4, wherein each of the positioning portions is configured to extend between a corresponding pair of the plurality of first recessed portions in the third direction.

7. The charging unit according to claim 1, further comprising:

a grid electrode provided between the discharge electrode and the surface of the image bearing member, wherein the grid electrode includes a second recessed portion and a second non-recessed portion, the second recessed portion being formed by at least two bends in a surface of the grid electrode.

8. The charging unit according to claim 7, wherein the second recessed portion protrudes toward the image bearing member.

9. The charging unit according to claim 7, wherein a location of the first recessed portion along the surface of the second shield electrode is outside of a circular area, the circular area defined by a center of the discharge electrode in a cross section perpendicular to the second direction and a radius equal to the shortest linear distance between the discharge electrode and the first shield electrode, the second shield electrode and the grid electrode.

10. The charging unit according to claim 7, wherein the grid electrode includes a plurality of electrode portions extending in the second direction, wherein the plurality of electrode portions are spaced apart from one another.

11. The charging unit according to claim 1, wherein a length of the first recessed portion of the second shield electrode in the second direction is greater than a width in the second direction of a region of the surface of the image bearing member in which an electrostatic latent image is formed.

12. The charging unit according to claim 1, wherein the first shield electrode includes a second recessed portion and a second non-recessed portion, the second recessed portion of the first shield electrode being formed by at least two bends in a surface of the first shield electrode.

13. The charging unit according to claim 12, wherein the second recessed portion and the first recessed portion are formed so as to be symmetrical about an axis, the axis extending through a center of the discharge electrode and a center of the image bearing member.

14. A discharging unit configured to discharge toward a surface of an image bearing member moving in a first direction, the discharging unit comprising:

a discharge electrode extending in a second direction perpendicular to the first direction and parallel to the surface of the image bearing member, wherein the discharge electrode is spaced apart from the surface of the image bearing member;

a first shield electrode; and a second shield electrode disposed opposite to the first shield electrode, a surface of the second shield electrode including a first recessed portion and a first non-recessed portion, the first recessed portion being formed by at least two bends in the surface of the second shield electrode, wherein one of the first shield electrode and the second shield electrode is located at an upstream side of the discharge electrode in the first direction, and the other one of the first shield electrode and the second shield electrode is located at a downstream side of the discharge electrode in the first direction, and wherein a length of the first recessed portion in the second direction is less than an entire length of the second shield electrode in the second direction, the first recessed portion being enclosed by the first non-recessed portion at both ends in the second direction.

15. The discharging unit of claim 14, further comprising a grid electrode provided between the discharge electrode and the surface of the image bearing member, wherein the grid electrode includes a second recessed portion and a second non-recessed portion, the second recessed portion being formed by at least two bends in a surface of the grid electrode.

* * * * *